US012264023B2

(12) United States Patent
Morisawa et al.

(10) Patent No.: US 12,264,023 B2
(45) Date of Patent: Apr. 1, 2025

(54) MEDIUM CONVEYANCE DEVICE AND RECORDING DEVICE

(71) Applicant: SEIKO EPSON CORPORATION, Tokyo (JP)

(72) Inventors: Ryoichi Morisawa, Nagano (JP); Atsushi Nakazawa, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 176 days.

(21) Appl. No.: 18/179,423

(22) Filed: Mar. 7, 2023

(65) Prior Publication Data

US 2023/0278818 A1 Sep. 7, 2023

(51) Int. Cl.
*B65H 1/26* (2006.01)
*B65H 3/06* (2006.01)

(52) U.S. Cl.
CPC ..... *B65H 1/266* (2013.01); *B65H 3/0684* (2013.01); *B65H 2402/54* (2013.01); *B65H 2404/1521* (2013.01)

(58) Field of Classification Search
CPC ..... B65H 1/04; B65H 1/266; B65H 3/0684; B65H 2402/20; B65H 2402/31; B65H 2402/32; B65H 2402/54; B65H 2403/513; B65H 2404/152; B65H 2404/1521
See application file for complete search history.

(56) References Cited

U.S. PATENT DOCUMENTS

| | | | | |
|---|---|---|---|---|
| 8,573,587 | B2 * | 11/2013 | Yoshinaga | B65H 1/14 271/145 |
| 9,643,807 | B2 * | 5/2017 | Ishikawa | B65H 7/02 |
| 2005/0179192 | A1 * | 8/2005 | Miura | B65H 3/06 271/118 |
| 2016/0257508 | A1 * | 9/2016 | Nishiyama | B65H 5/36 |
| 2018/0148283 | A1 * | 5/2018 | Suzuki | G03G 21/1647 |

FOREIGN PATENT DOCUMENTS

| | | | |
|---|---|---|---|
| JP | 2002205832 | A | 7/2002 |
| JP | 2017109799 | A | 6/2017 |

* cited by examiner

*Primary Examiner* — Prasad V Gokhale
(74) *Attorney, Agent, or Firm* — CHIP LAW GROUP

(57) ABSTRACT

A direction orthogonal to an attachment/detachment direction is defined as a first direction and a direction orthogonal to the attachment/detachment direction and to the first direction is defined as a second direction. A sheet feeding cassette includes a contact portion that comes into contact with a roller separation mechanism unit, the contact portion including a first inclined surface inclined to extend along a straight line including a component in the attachment/detachment direction and a component in the first direction. The roller separation mechanism unit includes a contacted portion that comes into contact with the contact portion, the contacted portion including a second inclined surface inclined to extend along a straight line including a component in the attachment/detachment direction and a component in the second direction.

7 Claims, 30 Drawing Sheets

MEDIUM CONVEYANCE DEVICE AND RECORDING DEVICE

The present application is based on, and claims priority from JP Application Serial Number 2022-034183, filed Mar. 7, 2022, the disclosure of which is hereby incorporated by reference herein in its entirety.

BACKGROUND

1. Technical Field

The present disclosure relates to a medium conveyance device and a recording device.

2. Related Art

JP-A-2002-205832 discloses a sheet feed device that prevents paper jam in a device body through the following operations. Specifically, when a paper tray is pulled out from the device body, a contact portion is pushed back. At the same time, a nudger roll that is coupled to the contact portion and functions as a conveyance roller moves in a direction away from a sheet on the paper tray.

Unfortunately, there is a problem in that the technique described in JP-A-2002-205832 does not take into consideration a load involved in a movement of the nudger roll back to the original position at a timing when the paper tray is inserted into the device body such after sheets have been set in the paper tray. In other words, there has been a demand for enabling a paper tray to be set in a device body using a small amount of force.

SUMMARY

A medium conveyance device includes a device body, a sheet feeding cassette detachably provided to the device body, a conveyance roller configured to come into contact with an upper surface of a medium placed on the sheet feeding cassette and convey the medium, and a roller separation mechanism unit that includes a biasing unit configured to perform biasing in a direction in which the conveyance roller is separated from the medium, has a rotation center along an attachment/detachment direction of the sheet feeding cassette, rotates in response to an operation of inserting the sheet feeding cassette to bring the conveyance roller into contact with the medium, and rotates in response to an operation of taking out the sheet feeding cassette to move the conveyance roller away from the medium, wherein a direction orthogonal to the attachment/detachment direction is defined as a first direction and a direction orthogonal to the attachment/detachment direction and to the first direction is defined as a second direction, the sheet feeding cassette includes a contact portion that comes into contact with the roller separation mechanism unit, the contact portion including a first inclined surface inclined to extend along a straight line including a component in the attachment/detachment direction and a component in the first direction, and the roller separation mechanism unit includes a contacted portion that comes into contact with the contact portion, the contacted portion including a second inclined surface inclined to extend along a straight line including a component in the attachment/detachment direction and a component in the second direction.

A recording device includes the medium conveyance device described above, and a recording unit configured to perform recording on the medium conveyed from the medium conveyance device.

DESCRIPTION OF EXEMPLARY EMBODIMENTS

The following description is given with reference to the drawings including a X axis, a Y axis, and a Z axis that are three axes orthogonal to each other. A direction along the X axis is referred to as "X direction", a direction along the Y axis is referred to as "Y direction", and a direction along the Z axis is referred to as "Z direction". A direction indicated by an arrow is a + direction, and a direction opposite to the + direction is a − direction. Note that, a +Z direction may be also referred to as "up" or an "upper side", and a −Z direction may be also referred to as "down" or a "lower side". Furthermore, as viewed in the +Z direction is referred to as in plan view or plane view. Furthermore, the description is given assuming that a surface on the + side in the Z direction is an upper surface, and a surface on the opposite side, that is, on the − side in the Z direction is a lower side. The Z direction is also referred to as a vertical direction. A direction along the Y direction is also referred to as an attachment/detachment direction, a direction along the X direction is also referred to as a first direction, and a direction along the Z direction orthogonal to the attachment/detachment direction and the first direction is also referred to as a second direction.

The attachment/detachment direction is a direction in which a sheet feeding cassette 1600 is inserted into a device body 1100, and in which the sheet feeding cassette 1600 is removed from the device body 1100. The sheet feeding cassette 1600 may be completely removed from the device body 1100, or part of the sheet feeding cassette 1600 may be removed from the device body 1100.

First of all, configurations of a medium conveyance device 1000*a* and a printer 1000 will be described with reference to FIG. 1.

Figure 1:
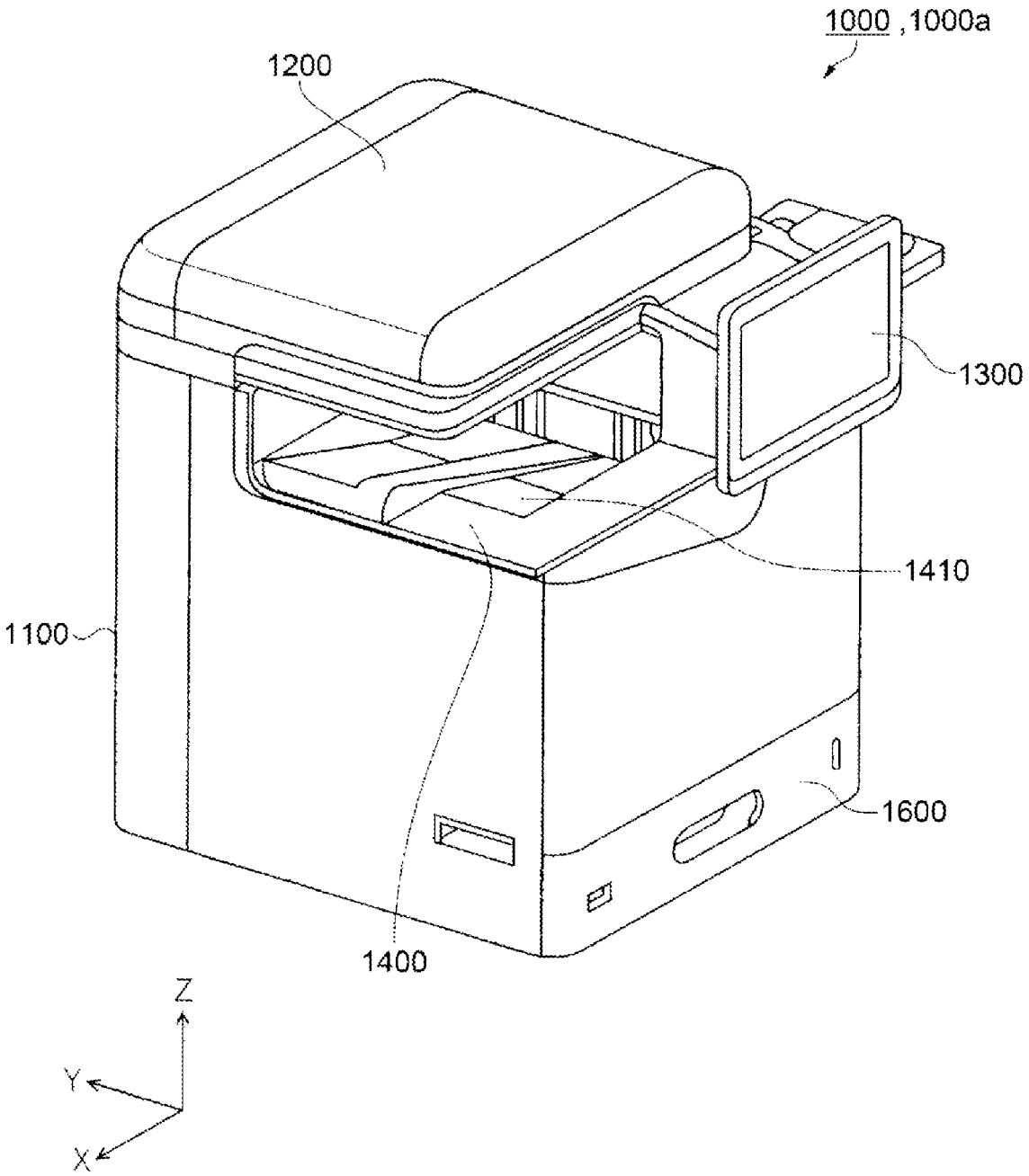
FIG. 1 is a perspective view illustrating a configuration of a recording device.

As illustrated in FIG. 1, the printer 1000 serving as a recording device performs recording by discharging ink onto a sheet 1500 serving as a medium. The printer 1000 includes the device body 1100, and a scanner unit 1200 disposed in an upper portion of the device body 1100.

An operation panel 1300 is disposed on the −Y direction side of the device body 1100. Parts of the device body 1100 on the −Y direction side and on the +X direction side are an open region 1400. The open region 1400 is a region from which the sheet 1500 recorded and discharged is taken out. The open region 1400 has a bottom surface used as a discharge tray 1410.

The sheet feeding cassette 1600 containing the sheet 1500 is disposed on the lower side and on the −Y direction side of the device body 1100. The sheet feeding cassette 1600 can be pulled out from and inserted into the device body 1100 respectively toward the −Y direction side and +Y direction side. Thus, the sheet feeding cassette 1600 is disposed to be detachable and attachable from and to the device body 1100.

Figure 2:
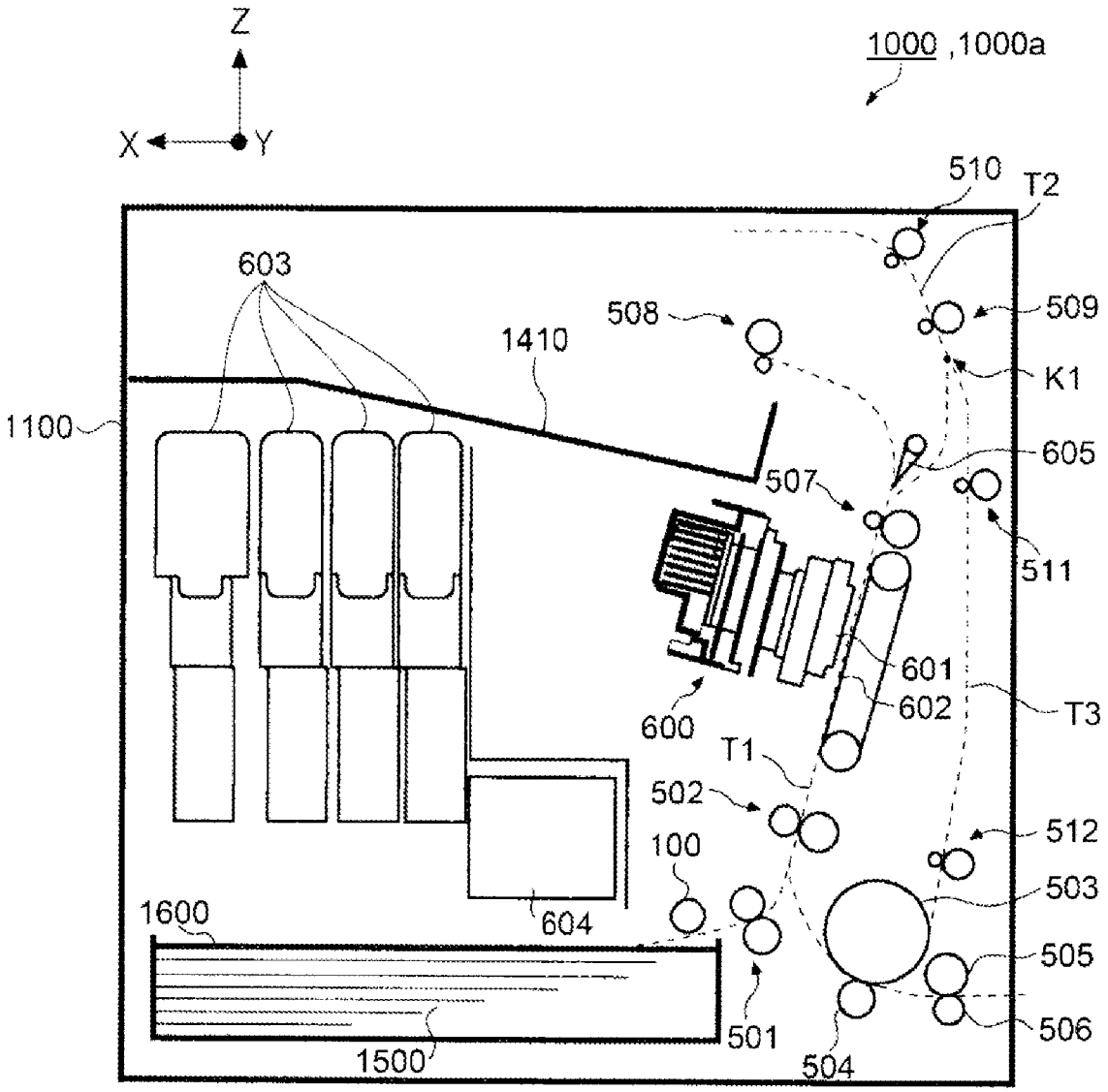
FIG. 2 is a cross-sectional view illustrating a configuration of a recording device.

Next, a medium conveyance path of the printer 1000 will be described with reference to FIG. 2. In FIG. 2, the medium conveyance path is illustrated in a dashed line.

A conveyance roller 100 that feeds the contained sheet 1500 in the −X direction is disposed above the sheet feeding cassette 1600. Specifically, the conveyance roller 100 is disposed to be capable of coming into contact with the upper surface of the sheet 1500. On the −X direction side of the conveyance roller 100, a feed roller pair 501 and a conveyance roller pair 502 that convey the sheet 1500 that has been fed in the −X direction, in an obliquely upward direction. The feed roller pair 501 includes a drive roller and a driven roller that is in contact with the driving roller to be driven to rotate for example.

On the −X direction side of the feed roller pair 501, a reversing roller 503 and a driven roller 504, as well as a feed roller 505 and a separation roller 506 are disposed. The feed roller 505 and the separation roller 506 form a roller pair that feeds the sheet 1500 from a feed tray not illustrated.

The sheet 1500 sent from the conveyance roller pair 502 is sent to a recording position between a line head 601 and a conveyer belt 602, to face the line head 601. A medium conveyance path from the conveyance roller pair 502 to a conveyance roller pair 507 is referred to as a for-recording-conveyance path T1.

The line head 601 forms a head unit 600 serving as a recording unit. The line head 601 performs recording by discharging ink onto a surface of the sheet 1500.

Ink containing units 603 containing ink of respective colors are disposed on the lower side of the discharge tray 1410. A waste liquid containing unit 604 that receives waste ink is disposed on the lower side and on the +X direction side of the head unit 600.

After having recording performed on one surface by the line head 601, the sheet 1500 is further sent upward by the conveyance roller pair 507. A flap 605 that switches the conveyance direction of the sheet 1500 is provided above the conveyance roller pair 507.

When the sheet 1500 in this state is to be discharged, the flap 605 switches the conveyance path of the sheet 1500 to a path leading to a conveyance roller pair 508 above. The conveyance roller pair 508 discharges the sheet 1500 onto the discharge tray 1410.

When the recording is to be performed on the other surface of the sheet 1500 in addition to the one surface, the flap 605 switches the conveyance direction of the sheet 1500 to a path leading to a branching position K1. The sheet 1500 passes through the branching position K1 to enter a switchback path T2. Conveyance roller pairs 509 and 510 are provided on the switchback path T2. The conveyance roller pairs 509 and 510 convey the sheet 1500 that has entered the switchback path T2, in the upward direction. When the lower edge of the sheet 1500 passes through the branching position K1, the rotation direction of the conveyance roller pairs 509 and 510 is reversed to convey the sheet 1500 in the downward direction.

The switchback path T2 is coupled to a reversing path T3. In the present embodiment, the reversing path T3 is a medium conveyance path extending from the branching position K1 to the reversing roller 503 through conveyance roller pairs 511 and 512.

The sheet 1500 conveyed in the downward direction from the branching position K1 is conveyed by the conveyance roller pairs 511 and 512 to reach the reversing roller 503 to be reversed while being curved by the reversing roller 503, and then is sent to the conveyance roller pair 502.

The sheet 1500 again sent to the position to face the line head 601 has the other surface, different from the one surface on which the recording has been performed, facing the line head 601. Thus, the line head 601 can perform the recording on the other surface of the sheet 1500.

Next, the operational relationship among the conveyance roller 100, a roller separation mechanism unit 210, and the sheet feeding cassette 1600 forming the medium conveyance device 1000*a* will be described with reference to FIG. 3 to FIG. 9.

Figure 3:
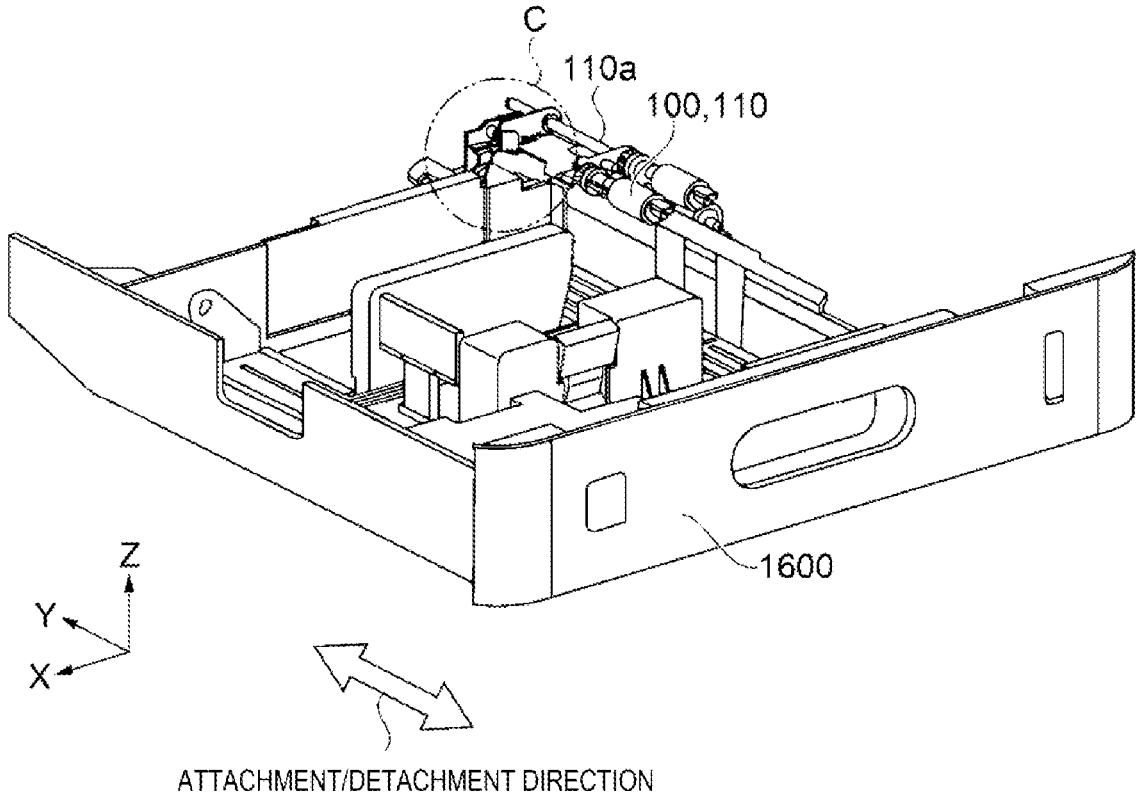
FIG. 3 is a perspective view illustrating a configuration of a sheet feeding cassette.
Figure 4:
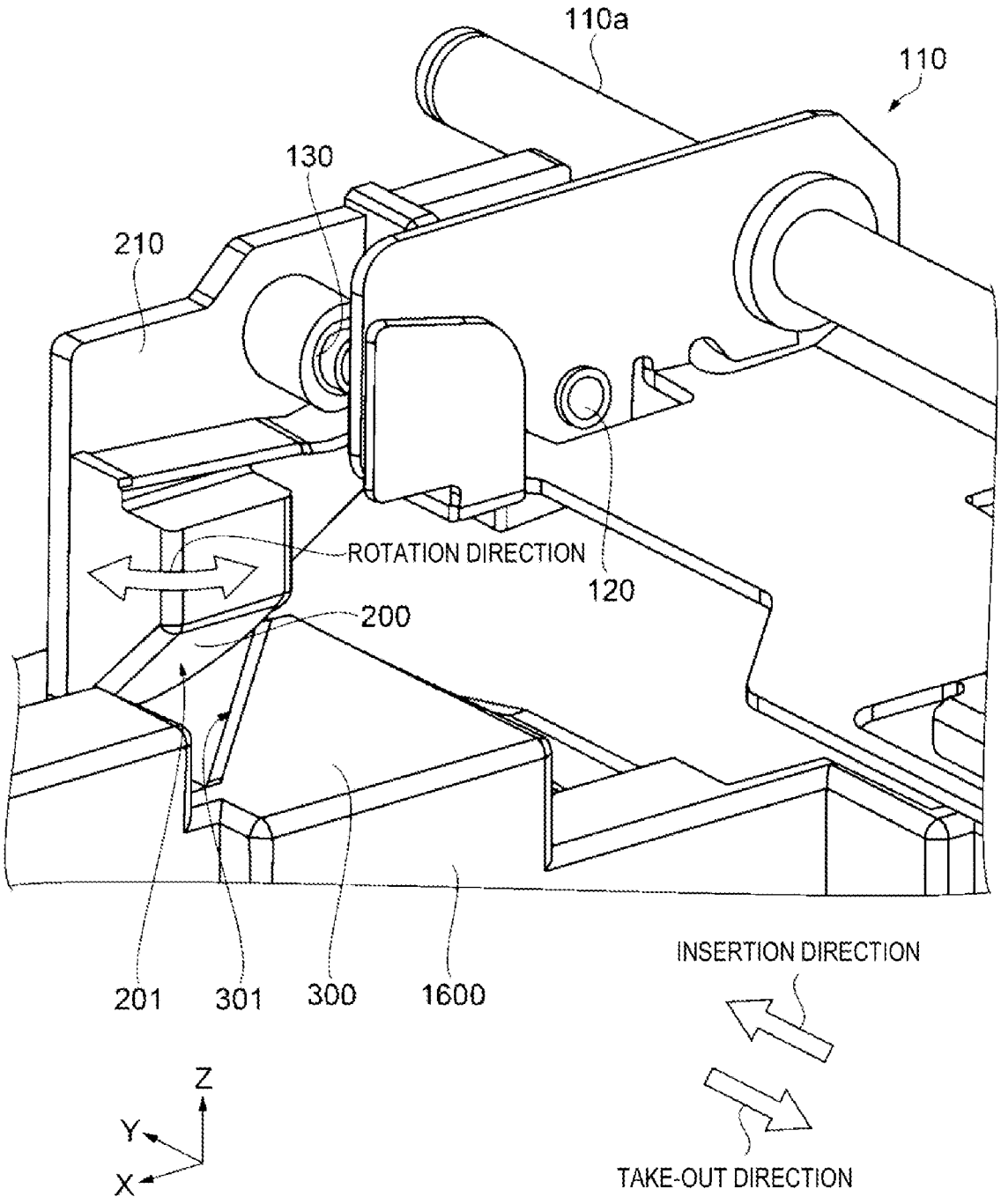
FIG. 4 is an enlarged perspective view of a C part of the sheet feeding cassette illustrated in FIG. 3.

As illustrated in FIG. 3 and FIG. 4, the sheet feeding cassette 1600 is provided with a contact portion 300 that comes into contact with the roller separation mechanism unit 210, on the +Y direction side. The contact portion 300 includes a first inclined surface 301 inclined to extend along a straight line including a component in the attachment/detachment direction that is a direction along the Y direction and the first direction that is a direction along the X direction.

Figure 7:
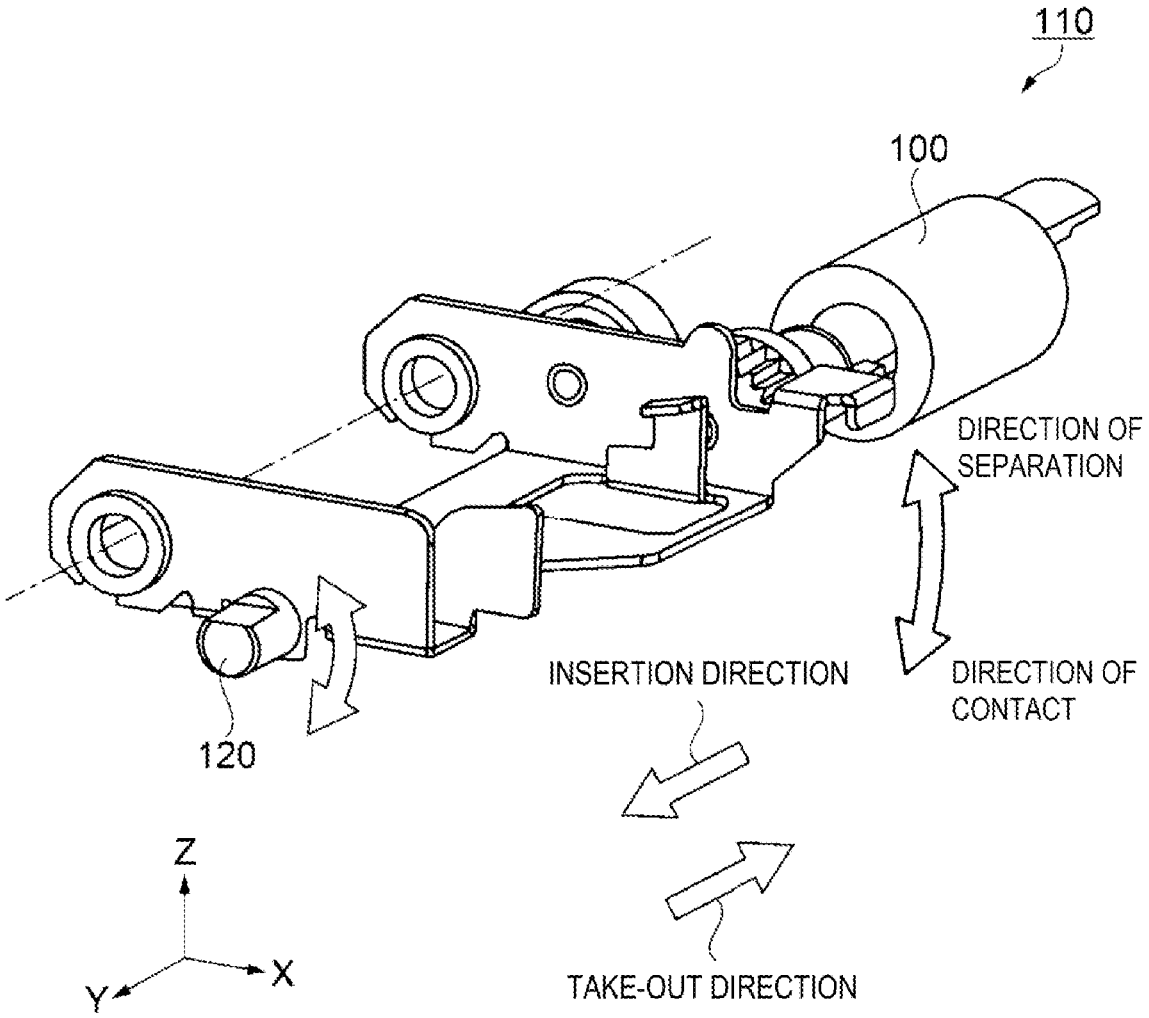
FIG. 7 is a perspective view illustrating a configuration of a conveyance roller unit.

As illustrated in FIG. 3, a conveyance roller unit 110, illustrated in FIG. 7, including the conveyance roller 100 is disposed on the −X direction side of the sheet feeding cassette 1600. The conveyance roller unit 110 is attached to a rotation shaft 110*a* of the feed roller. In the conveyance roller unit 110, the conveyance roller 100 is attached to a rotation shaft having the rotation center along the attachment/detachment direction of the sheet feeding cassette 1600.

An operation of inserting the sheet feeding cassette 1600 involves rotation of the conveyance roller unit 110 about the rotation shaft 110*a* to bring the conveyance roller 100 into contact with the sheet 1500. An operation of taking out the sheet feeding cassette 1600 involves rotation of the conveyance roller unit 110 about the rotation shaft 110*a* to separate the conveyance roller 100 from the sheet 1500.

Figure 21:
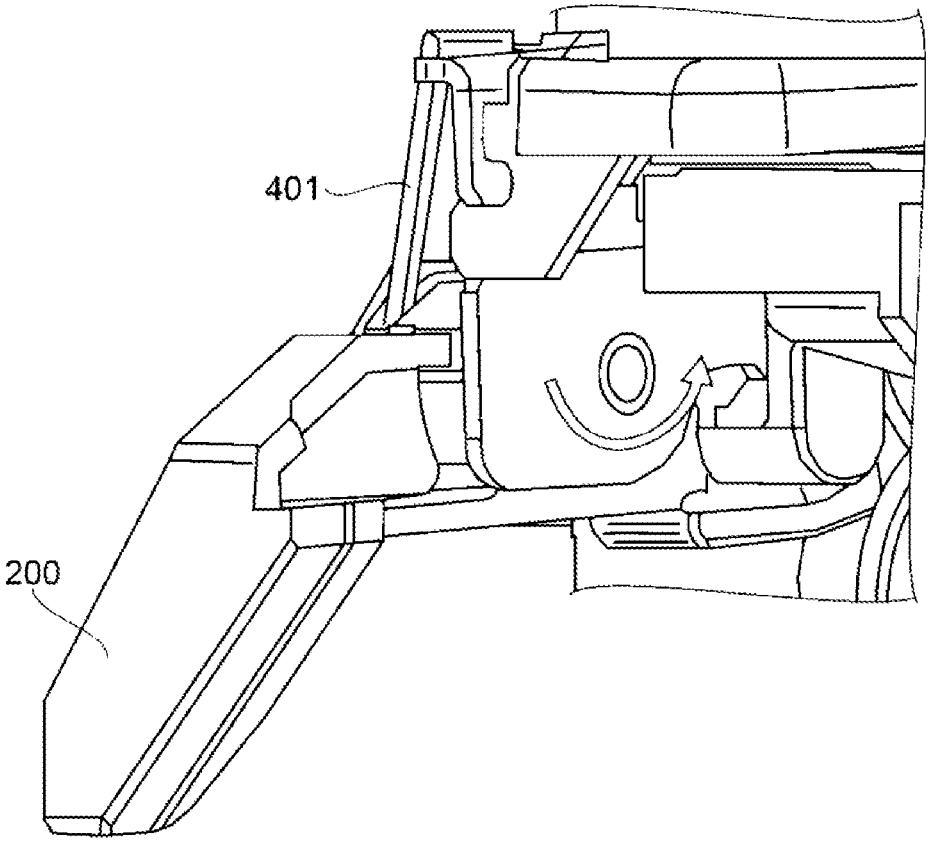
FIG. 21 is a perspective view illustrating a configuration of a periphery of the roller separation mechanism unit.
Figure 22:
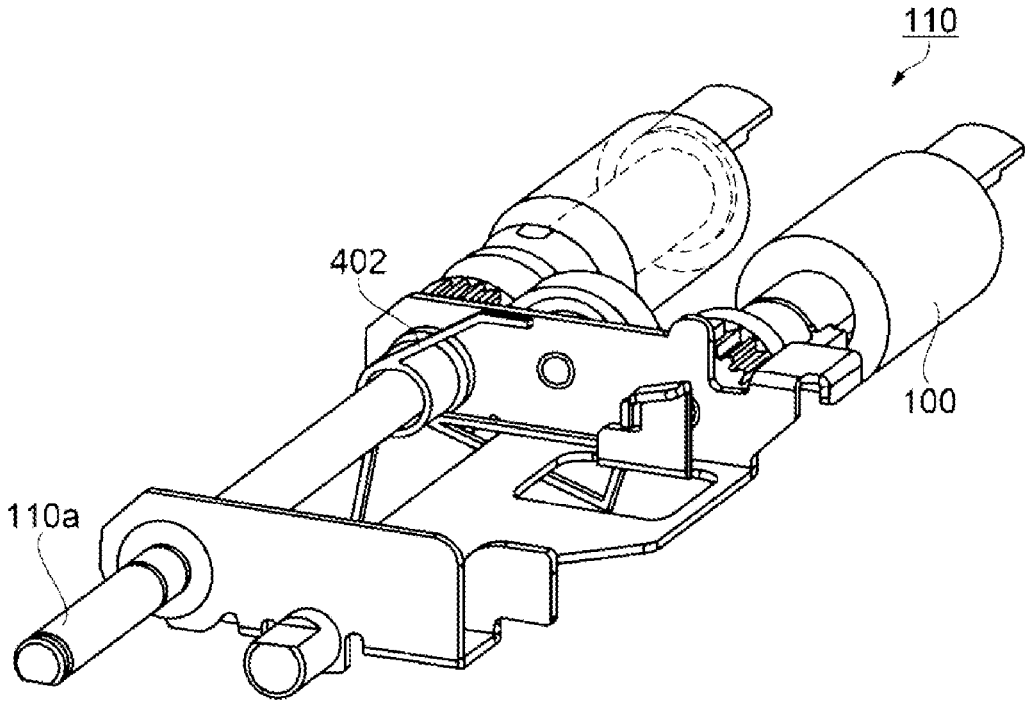
FIG. 22 is a perspective view illustrating a configuration of the conveyance roller unit.

The conveyance roller unit 110 is provided with, on the +Y direction side, a pin 120 extending in the +Y direction. The conveyance roller unit 110 includes a second biasing unit 402 (see FIG. 22) that biases the conveyance roller 100 to rotate in a direction to be in contact with the sheet 1500 about the rotation shaft 110*a* (see FIG. 21). The second biasing unit 402 is, for example, a torsion spring attached to the rotation shaft 110*a*. With the second biasing unit 402 provided, the conveyance roller 100 can be in contact with the sheet 1500 appropriately.

As illustrated in FIG. 4, the roller separation mechanism unit 210 is disposed on the +Y direction side of the conveyance roller unit 110 with a rotation shaft 130 provided in between. The sheet feeding cassette 1600 is provided with the contact portion 300 that comes into contact with the roller separation mechanism unit 210, on the +Y direction side.

Figure 6:
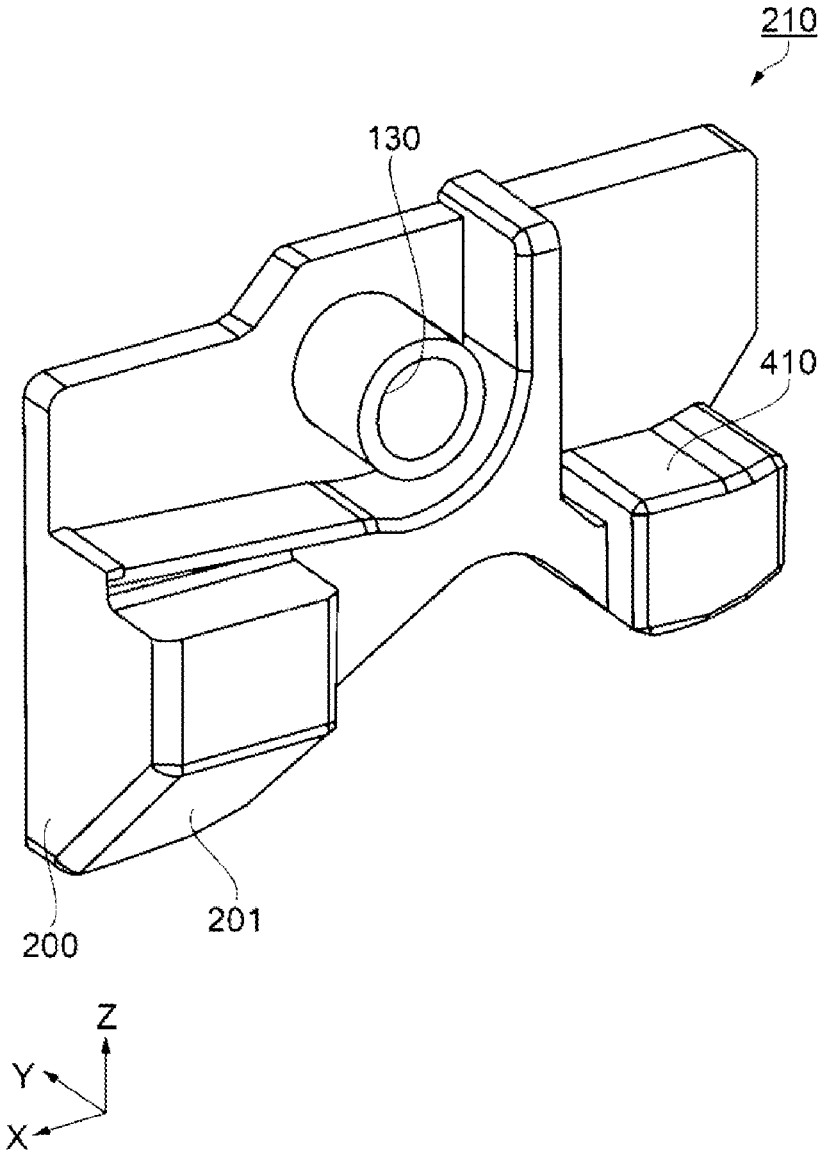
FIG. 6 is a perspective view illustrating a configuration of the roller separation mechanism unit.

As illustrated in FIG. 6, the roller separation mechanism unit 210 is provided to be rotatable about the rotation shaft 130. The roller separation mechanism unit 210 is provided with a contacted portion 200 that is provided on the +X direction side and comes into contact with the contact portion 300 of the sheet feeding cassette 1600, and a pin contact portion 410 that is provided on the −X direction side and comes into contact with the pin 120 of the conveyance roller unit 110. The contacted portion 200 includes a second inclined surface 201 inclined to extend along a straight line including a component in the attachment/detachment direction that is a direction along the Y direction and a component in the second direction that is a direction along the Z direction.

The roller separation mechanism unit 210 includes a first biasing unit 401 (see FIG. 21) that serves as a biasing unit for biasing to cause counterclockwise rotation in FIG. 6. The first biasing unit 401 is, for example, a torsion spring attached to the rotation shaft 130. Specifically, the roller separation mechanism unit 210 is biased by the second biasing unit 402 to have the contacted portion 200 rotated in the −Z direction about the rotation shaft 130.

The biasing force of the first biasing unit 401 is set to be greater than the biasing force of the second biasing unit 402. With the biasing force of the first biasing unit 401 set to be greater than the biasing force of the second biasing unit 402, the roller separation mechanism unit 210 can rotate the conveyance roller unit 110 in a direction in which the conveyance roller 100 separates from the sheet 1500.

FIG. 4 illustrates a state in which the conveyance roller 100 is separated from the sheet 1500. In this state, the first biasing unit 401 is making the pin contact portion 410 of the roller separation mechanism unit 210 lift the pin 120 of the conveyance roller unit 110.

Figure 5:
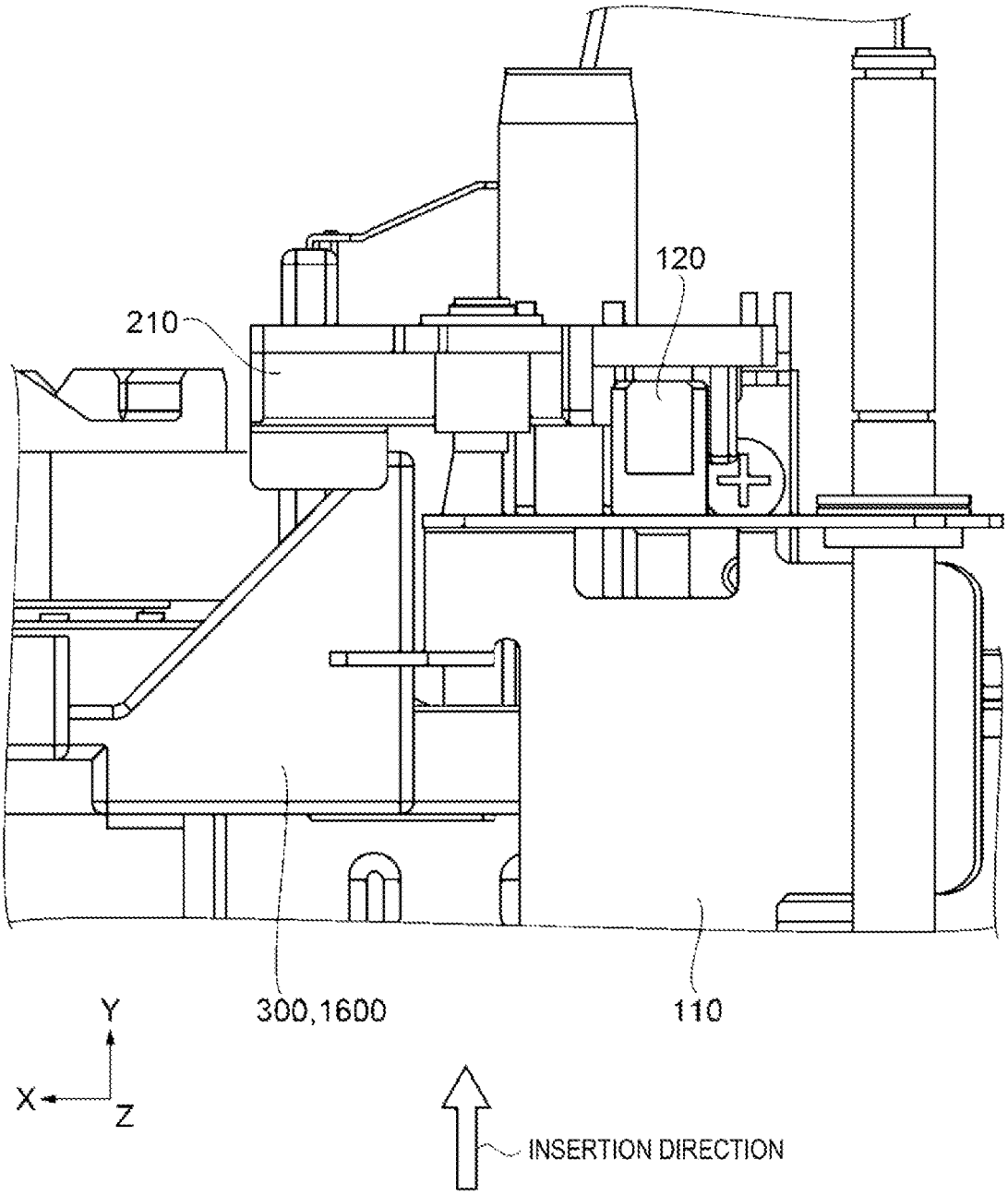
FIG. 5 is an upper plan view of the sheet feeding cassette and a roller separation mechanism unit in FIG. 4.

When the sheet feeding cassette 1600 is inserted into the device body 1100, the contact portion 300 of the sheet feeding cassette 1600 comes into contact with the contacted portion 200 of the roller separation mechanism unit 210 as illustrated in FIG. 4 and FIG. 5. With the first inclined surface 301 of the contact portion 300 and the second inclined surface 201 of the contacted portion 200 being in contact with each other, the contacted portion 200 of the roller separation mechanism unit 210 rotates in the +Z direction about the rotation shaft 130. The rotation of the roller separation mechanism unit 210 involves the rotation of the pin contact portion 410 in the −Z direction, resulting in a displacement of the conveyance roller unit 110 in the −Z direction. At this time, the roller separation mechanism unit 210 is being biased by the second biasing unit 402 in a direction in which the conveyance roller 100 is separated from the sheet 1500, so that the rotation can gradually proceed in a direction opposite to the biased direction.

Thus, when the sheet feeding cassette 1600 is inserted into the device body 1100, the conveyance roller 100 can be brought in contact with the sheet 1500, whereby the conveyance roller 100 can convey the sheet 1500 to the line head 601 so that the state where the recording can be performed on the sheet 1500 can be achieved.

Figure 8:
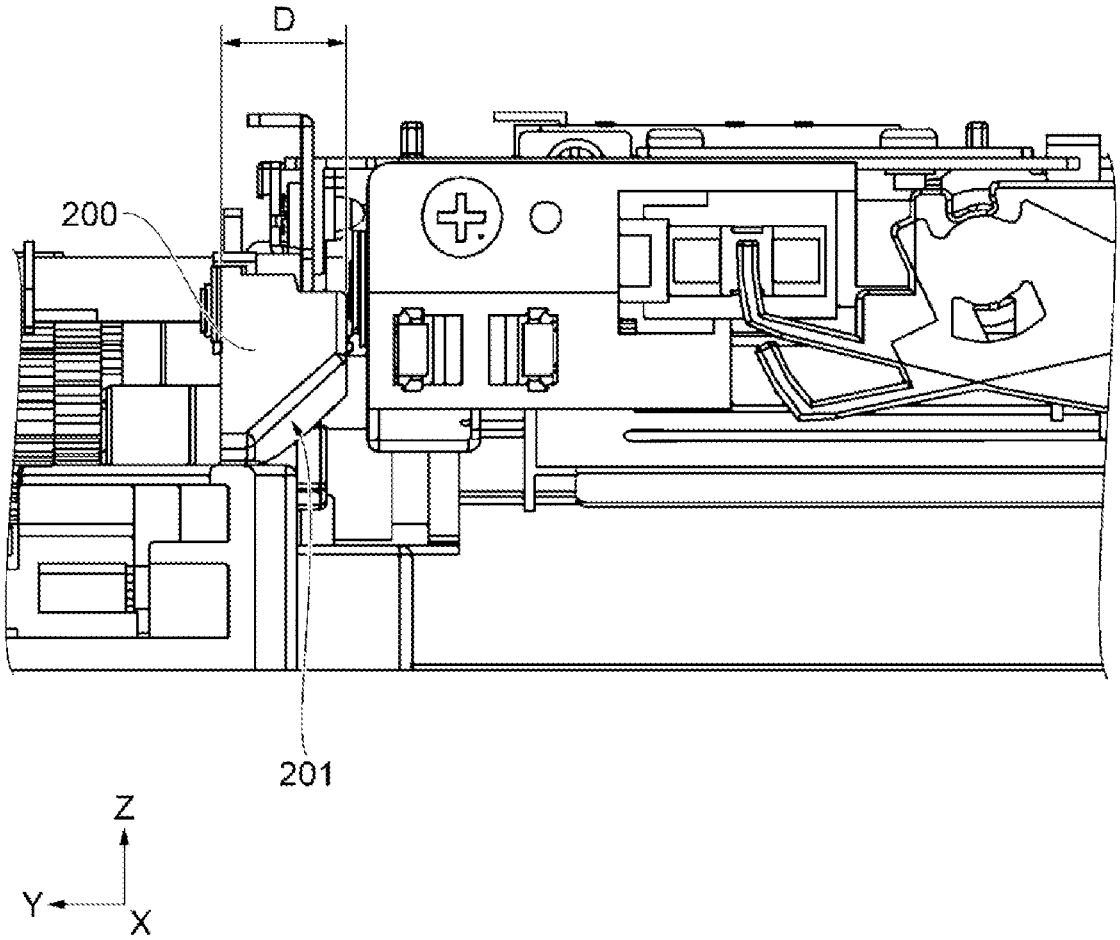
FIG. 8 is a side view illustrating a configuration of the roller separation mechanism unit.
Figure 9:
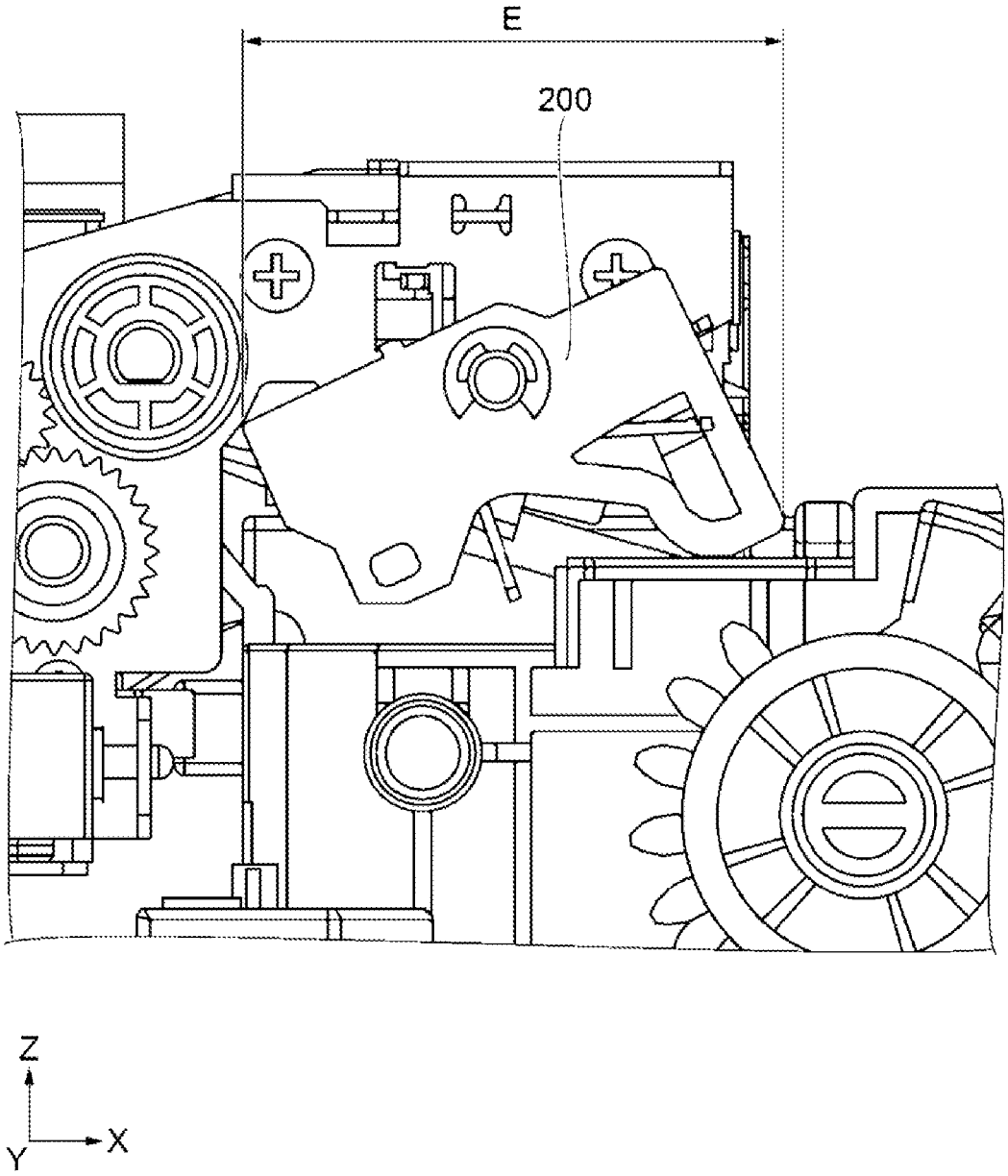
FIG. 9 is a side view illustrating a configuration of the roller separation mechanism unit.

Furthermore, with the contact portion 300 of the sheet feeding cassette 1600 provided with the first inclined surface 301 and with the contacted portion 200 of the roller separation mechanism unit 210 provided with the second inclined surface 201, the sheet feeding cassette 1600 can be inserted with a small insertion load compared with a known configuration without the inclined surface. For example, compared with a configuration where only the contacted portion 200 is provided with the second inclined surface 201, the roller separation mechanism unit 210 can have a small width D in the Y direction with the contact portion 300 provided with the first inclined surface 301 as illustrated in FIG. 8. Furthermore, as illustrated in FIG. 9, the roller separation mechanism unit 210 can have a small width E in the X direction.

Next, the operation of the roller separation mechanism unit 210 will described in detail with reference to FIGS. 10A to 10C, 11A to 11C, 12A to 12C, and 13A to 13C.

Figure 10A:
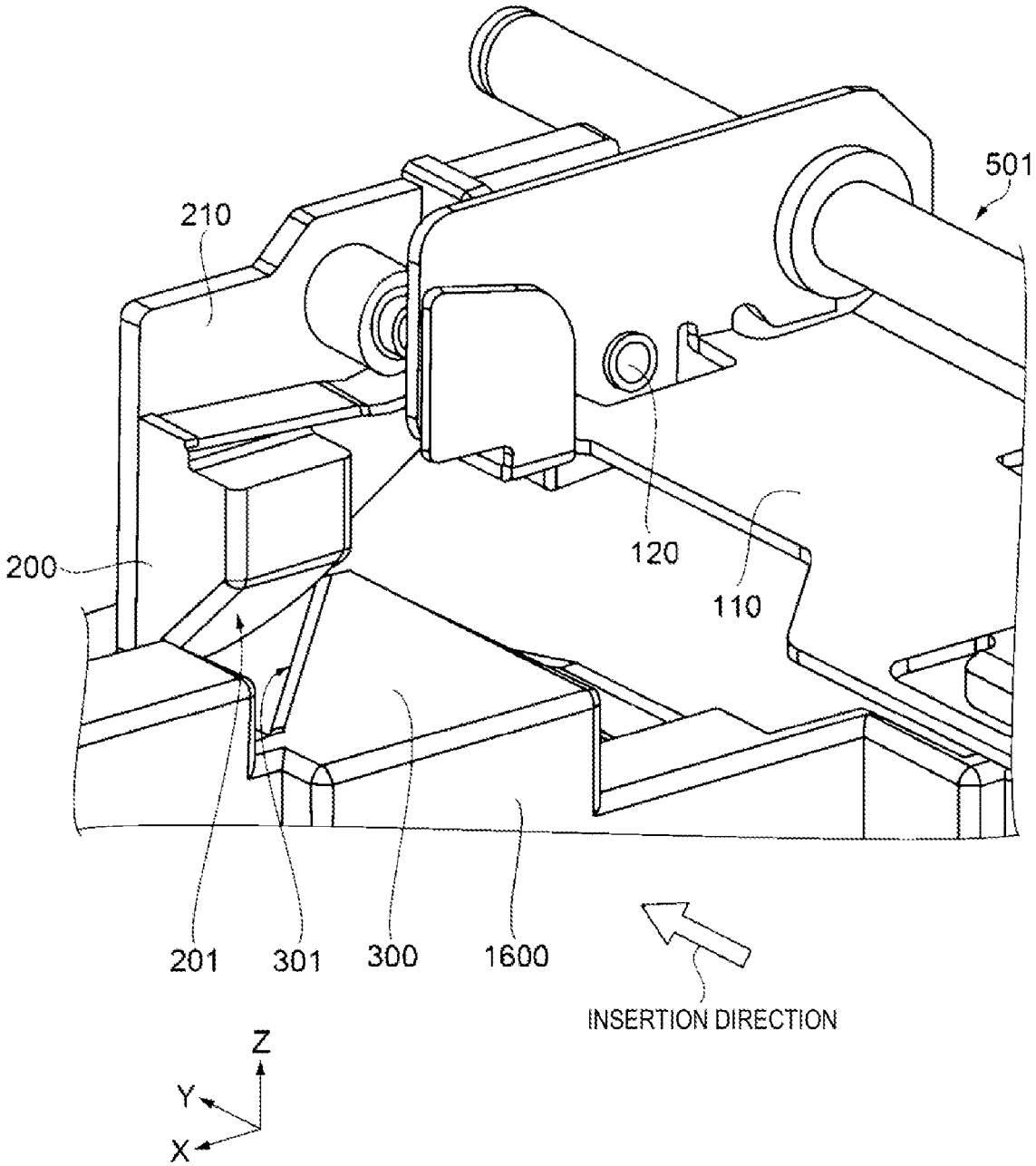
FIG. 10A is a perspective view illustrating an operation of the sheet feeding cassette and the roller separation mechanism unit.

First of all, in a step illustrated in FIG. 10A, the sheet feeding cassette 1600 is inserted into the device body 1100 along an insertion direction. The conveyance roller 100 is separated from the sheet 1500 due to the conveyance roller unit 110 being lifted by the first biasing unit 401. The roller separation mechanism unit 210 is in a state where the contacted portion 200 is lowered toward the contact portion 300. When the sheet feeding cassette 1600 is inserted, the first inclined surface 301 of the contact portion 300 of the sheet feeding cassette 1600 starts to be in contact with the second inclined surface 201 of the contacted portion 200 of the roller separation mechanism unit 210. This state will be referred to as a first state.

Figure 10B:
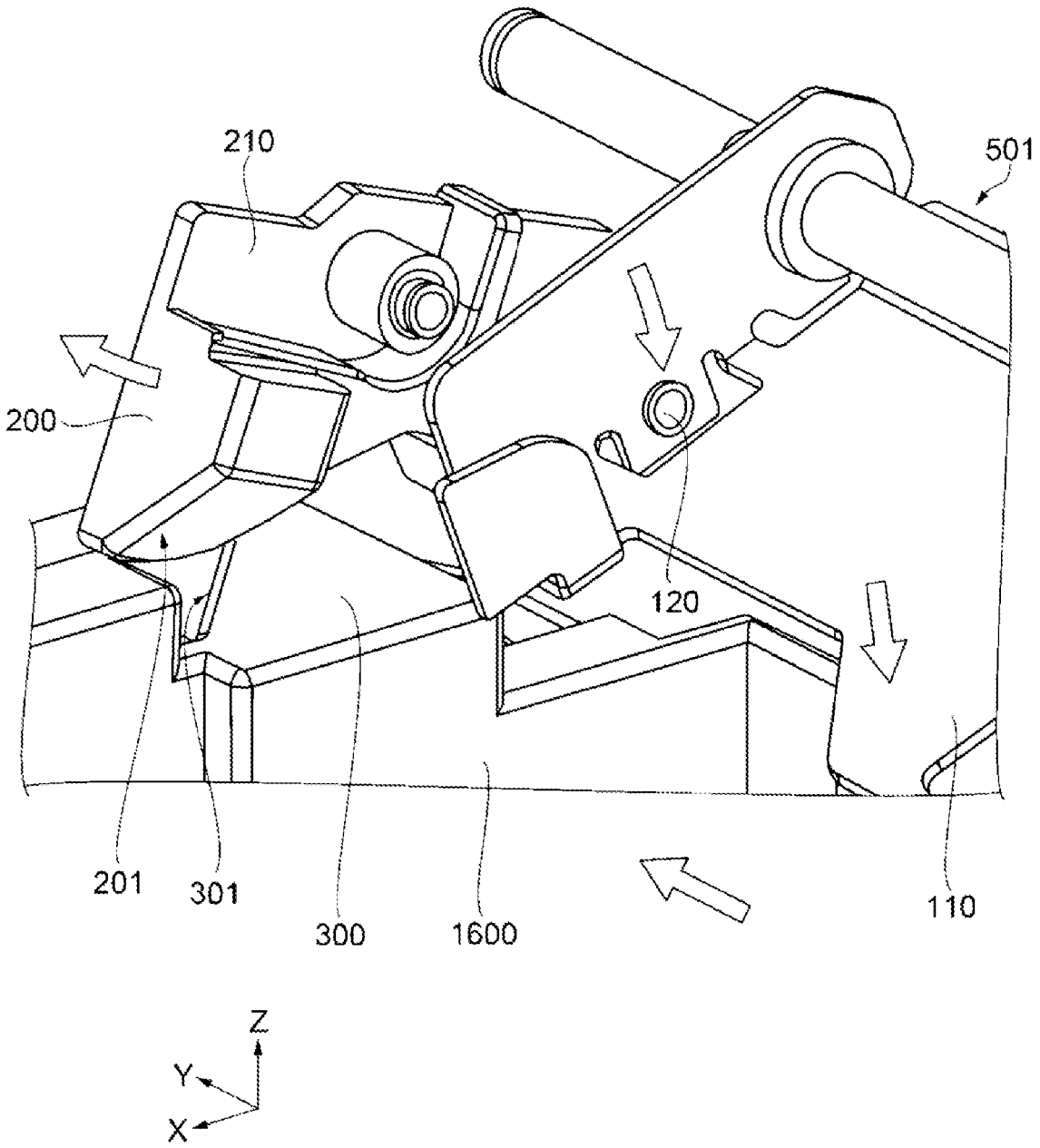
FIG. 10B is a perspective view illustrating an operation of the sheet feeding cassette and the roller separation mechanism unit.

Next, in a step illustrated in FIG. 10B, the sheet feeding cassette 1600 is further inserted, the contacted portion 200 starts to rotate about the rotation shaft 130 to be lifted along the first inclined surface 301 of the contact portion 300. As a result, one end of the conveyance roller unit 110 is inclined in the −Z direction to make the conveyance roller 100 approach the sheet 1500. This state is referred to as a second state.

Figure 10C:
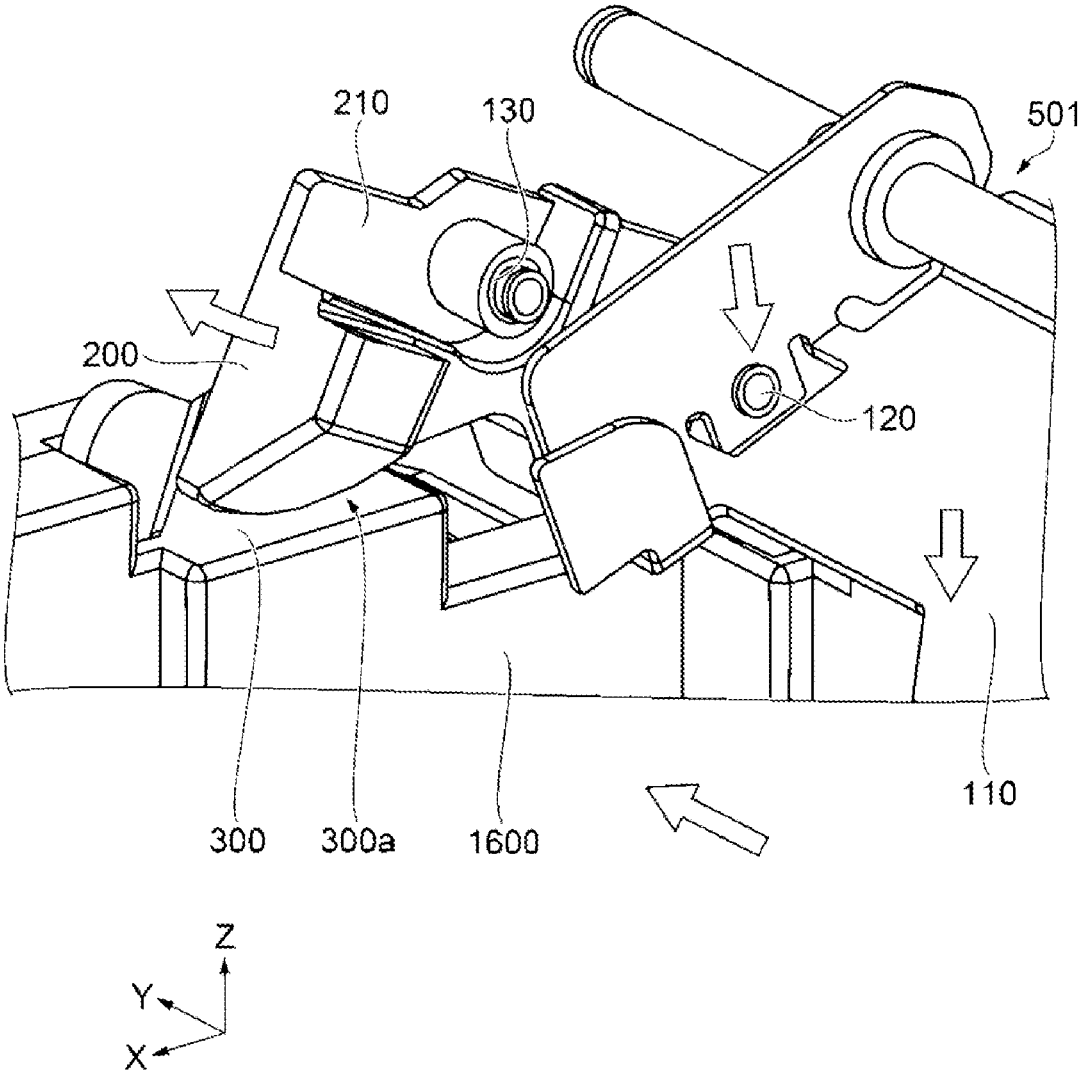
FIG. 10C is a perspective view illustrating an operation of the sheet feeding cassette and the roller separation mechanism unit.

Next, in a step illustrated in FIG. 10C, the sheet feeding cassette 1600 is inserted to a set position in the device body 1100. In this process, the contacted portion 200 of the roller separation mechanism unit 210 climbs over an upper surface 300*a* of the contact portion 300 of the sheet feeding cassette 1600. One end of the conveyance roller unit 110 is further inclined in the −Z direction. As a result, the conveyance roller 100 comes into contact with the sheet 1500. This state is referred to as a third state.

Figure 11A:
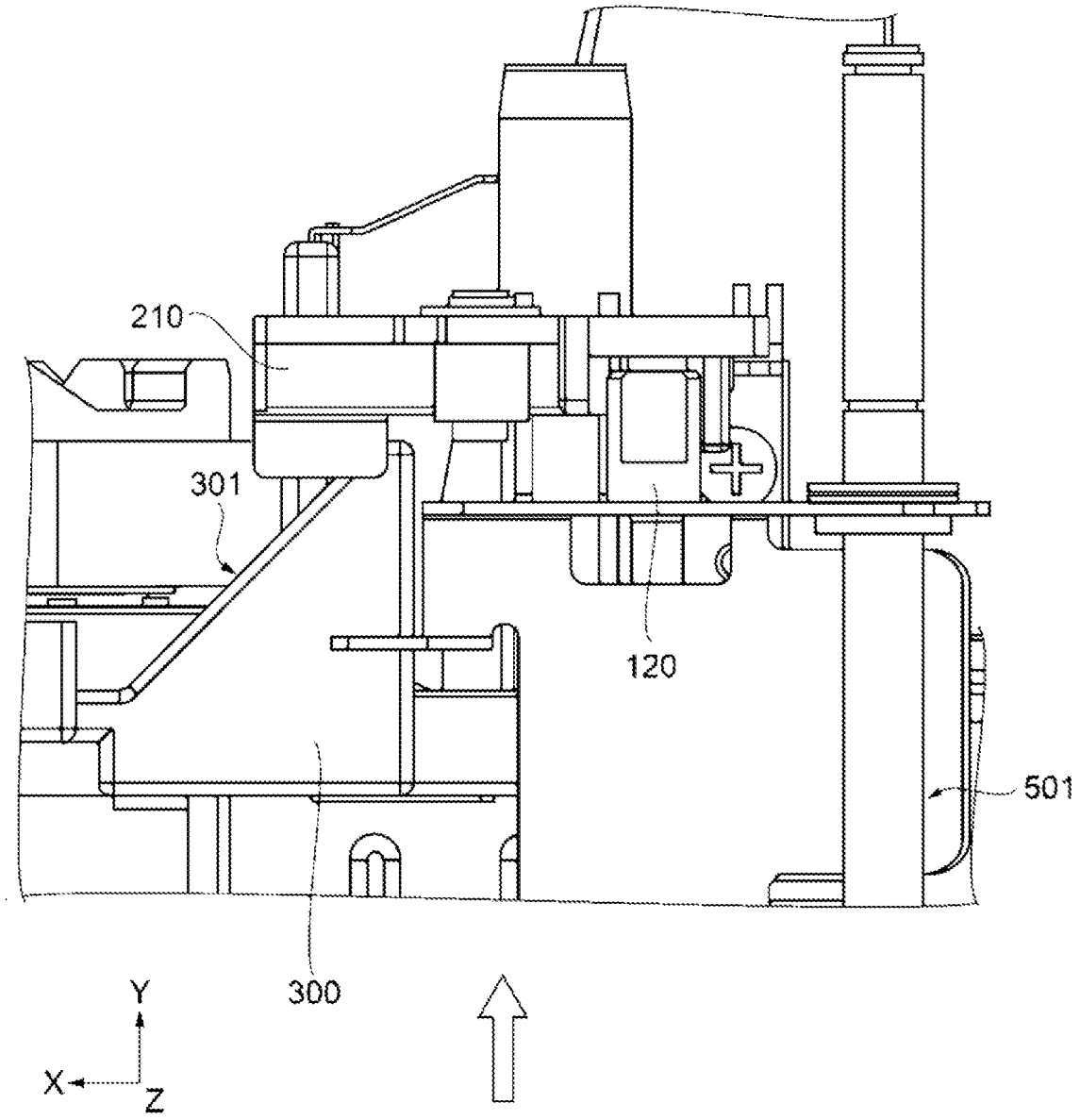
FIG. 11A is a plan view illustrating an operation of the sheet feeding cassette and the roller separation mechanism unit.
Figure 11B:
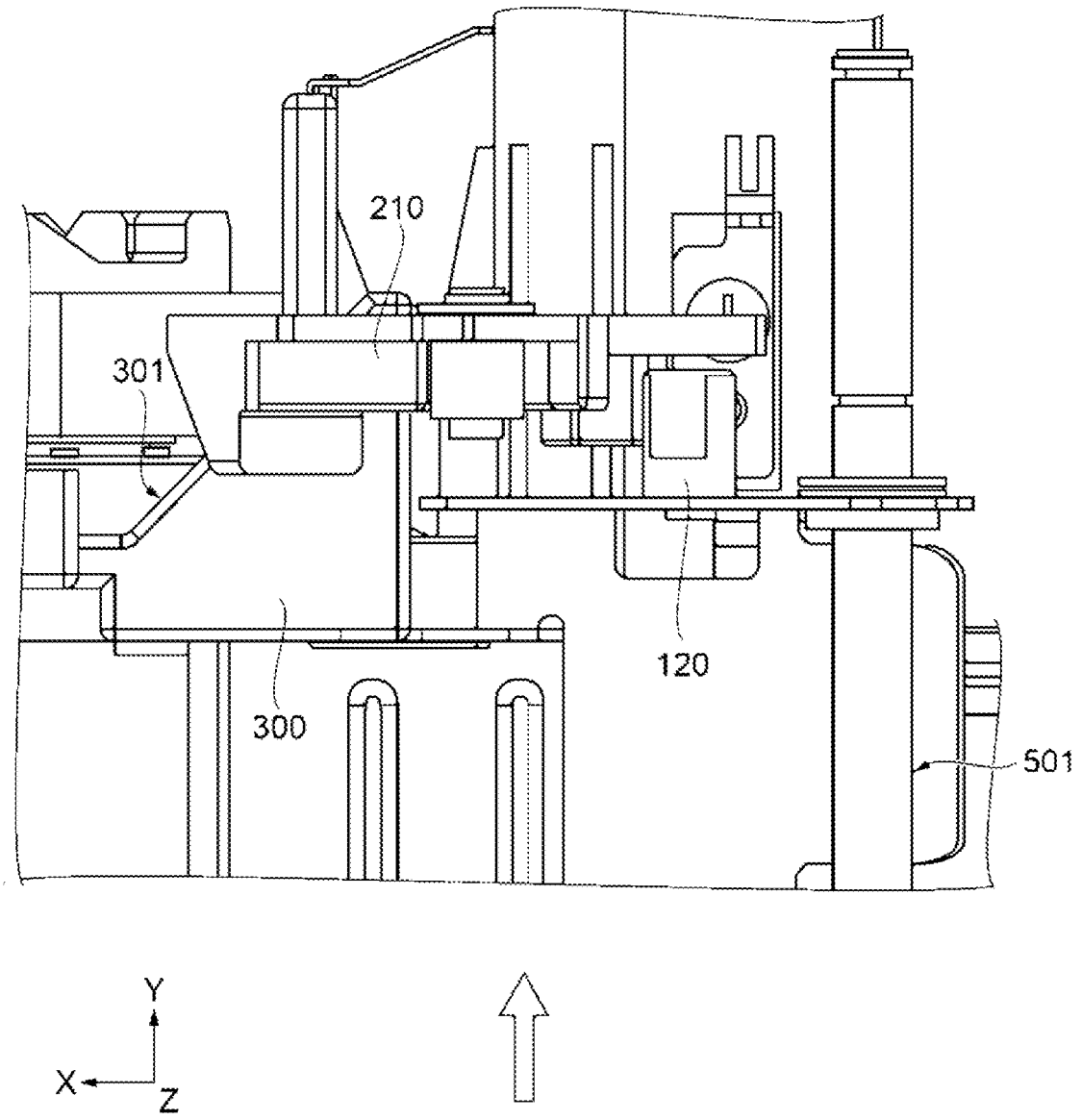
FIG. 11B is a plan view illustrating an operation of the sheet feeding cassette and the roller separation mechanism unit.
Figure 11C:
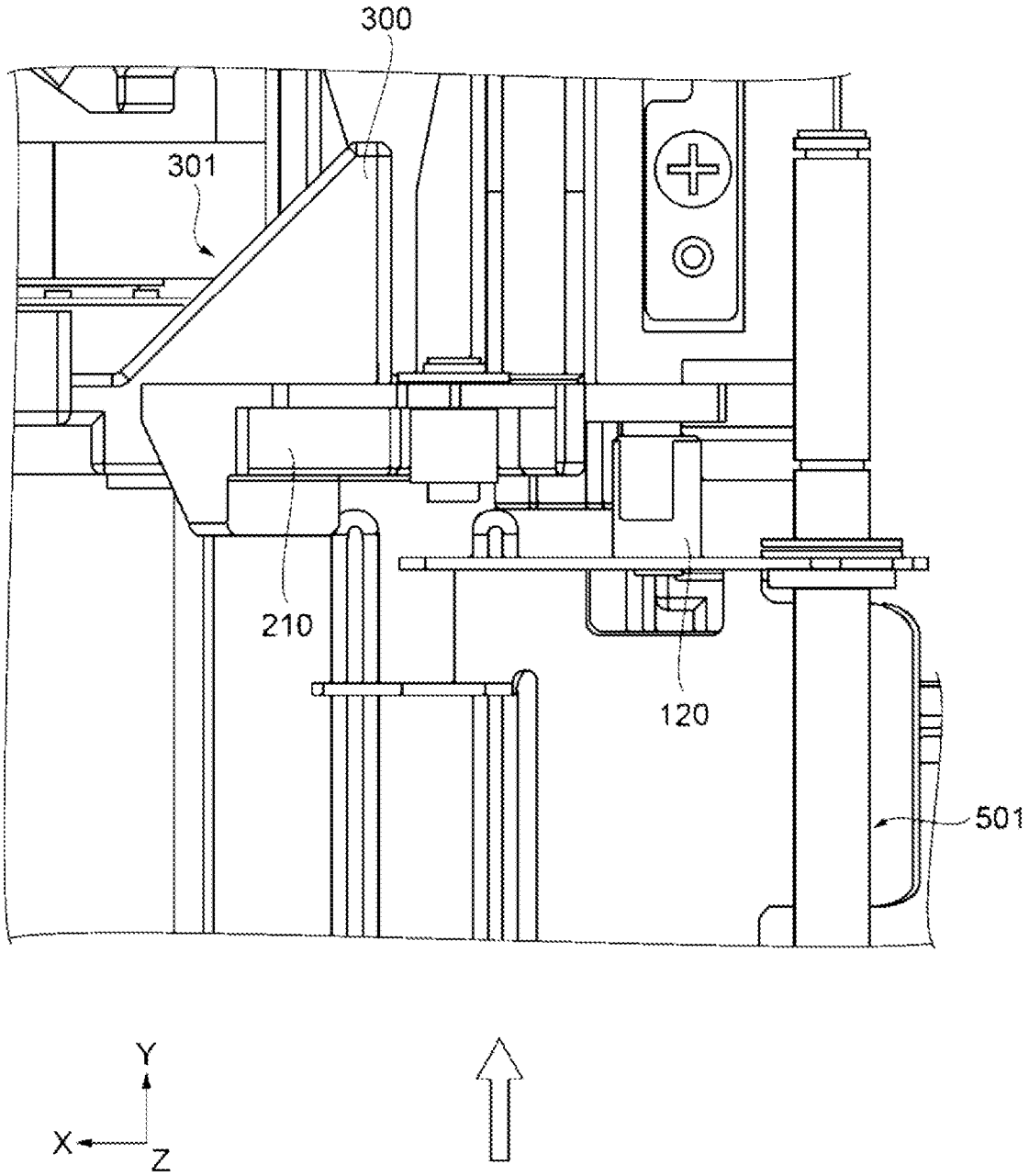
FIG. 11C is a plan view illustrating an operation of the sheet feeding cassette and the roller separation mechanism unit.
Figure 12A:
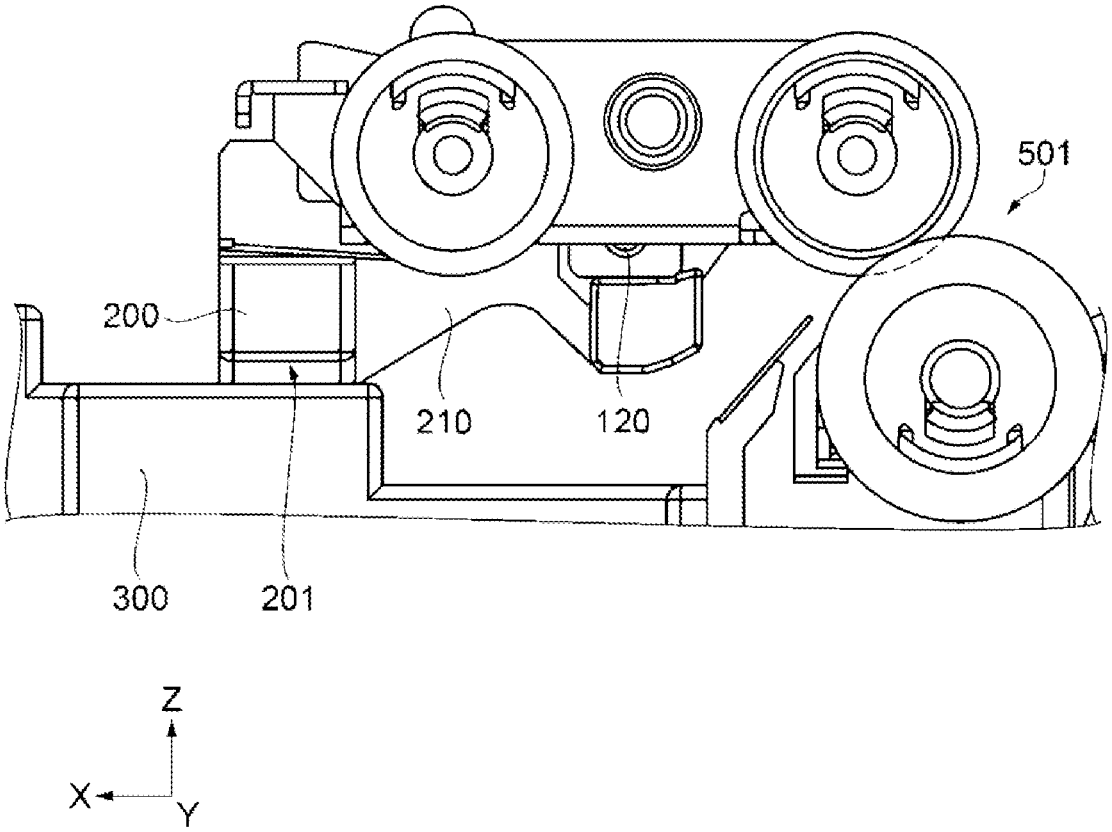
FIG. 12A is a side view illustrating an operation of the sheet feeding cassette and the roller separation mechanism unit.
Figure 12B:
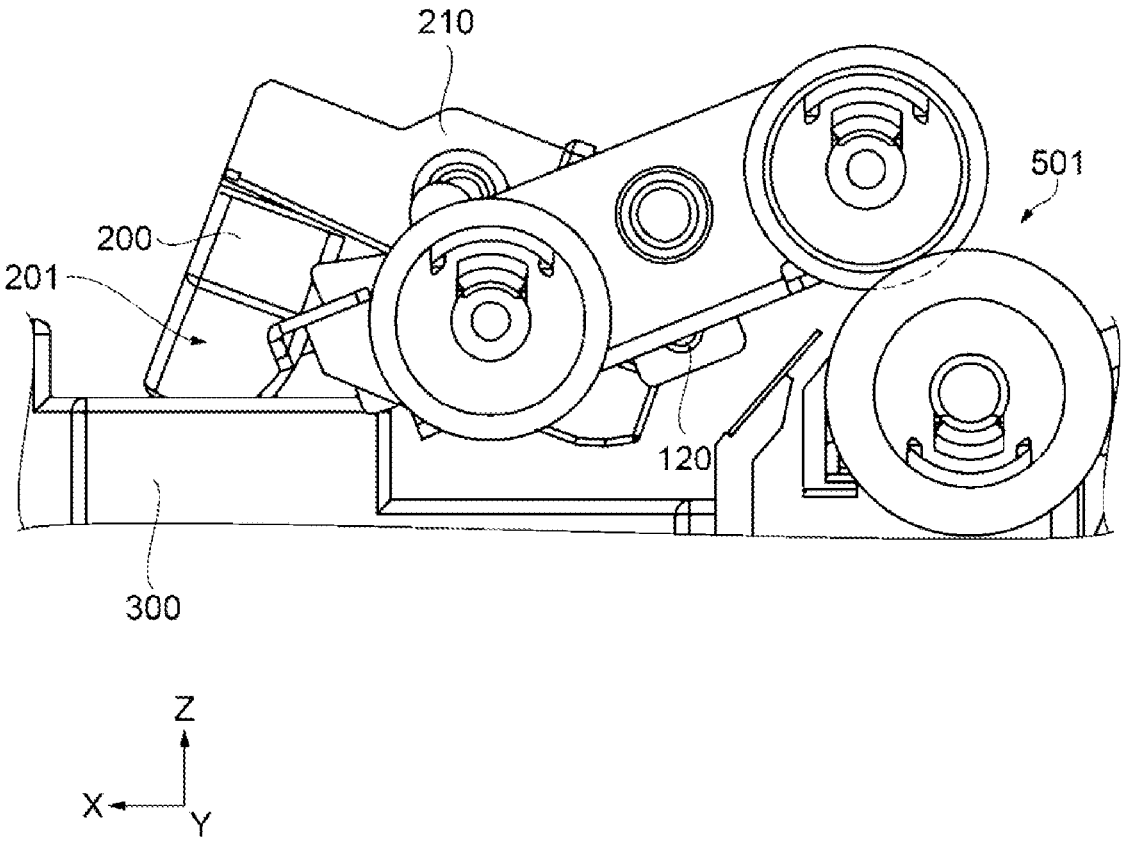
FIG. 12B is a side view illustrating an operation of the sheet feeding cassette and the roller separation mechanism unit.
Figure 12C:
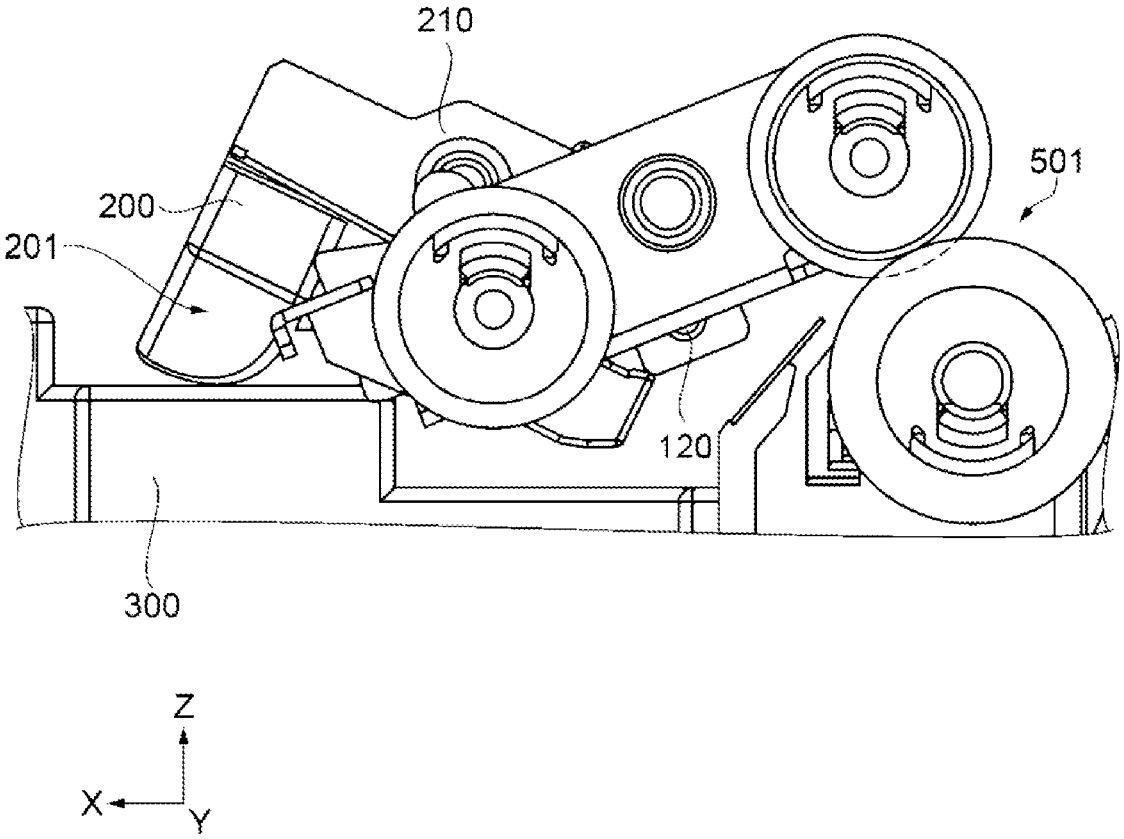
FIG. 12C is a side view illustrating an operation of the sheet feeding cassette and the roller separation mechanism unit.
Figure 13A:
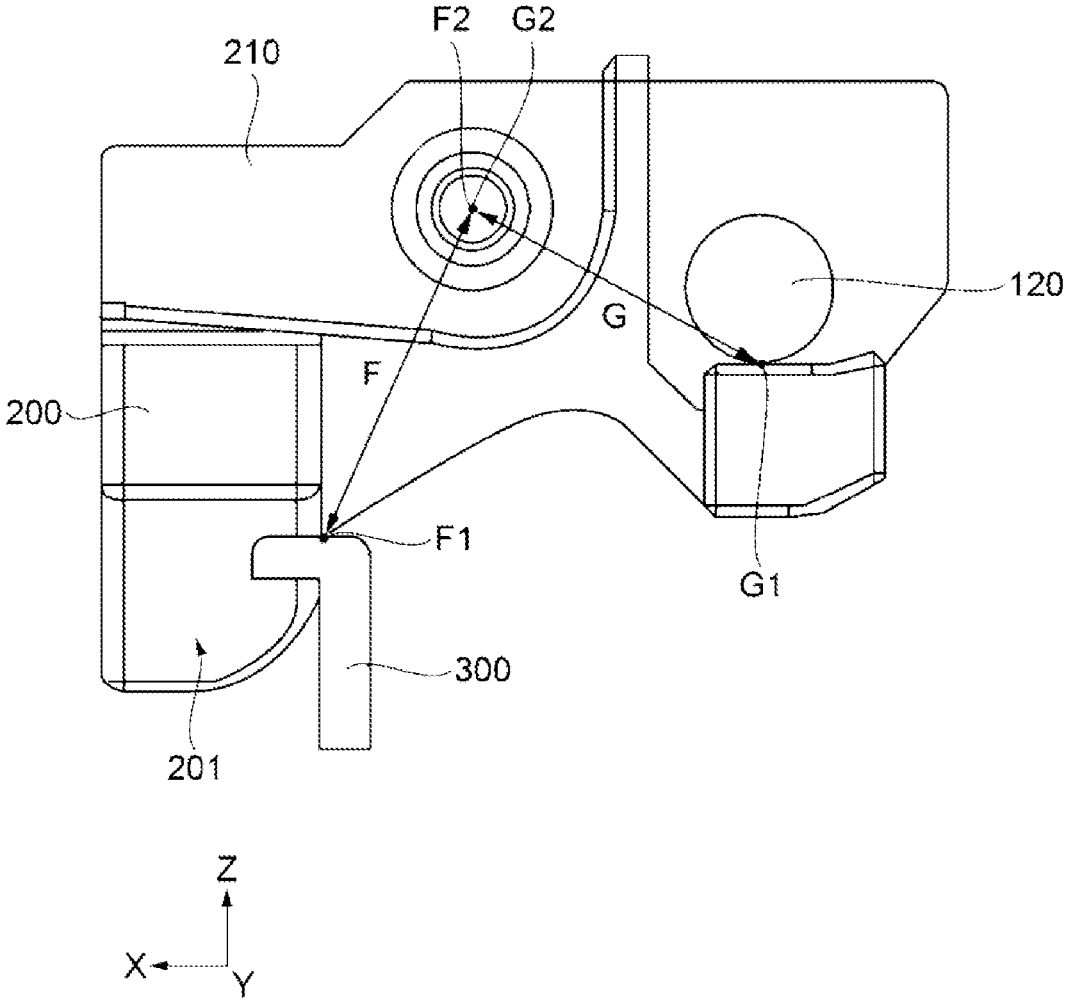
FIG. 13A is a side view illustrating an operation of the sheet feeding cassette and the roller separation mechanism unit.
Figure 13B:
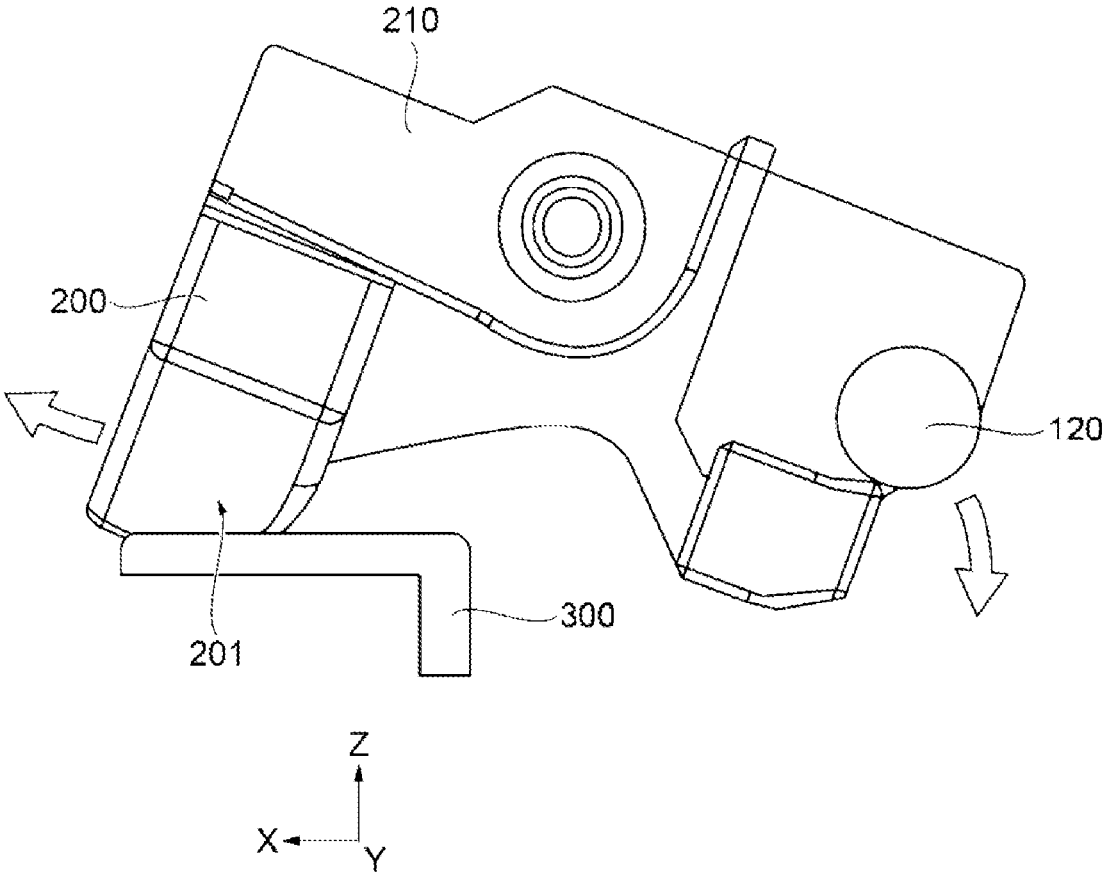
FIG. 13B is a side view illustrating an operation of the sheet feeding cassette and the roller separation mechanism unit.
Figure 13C:
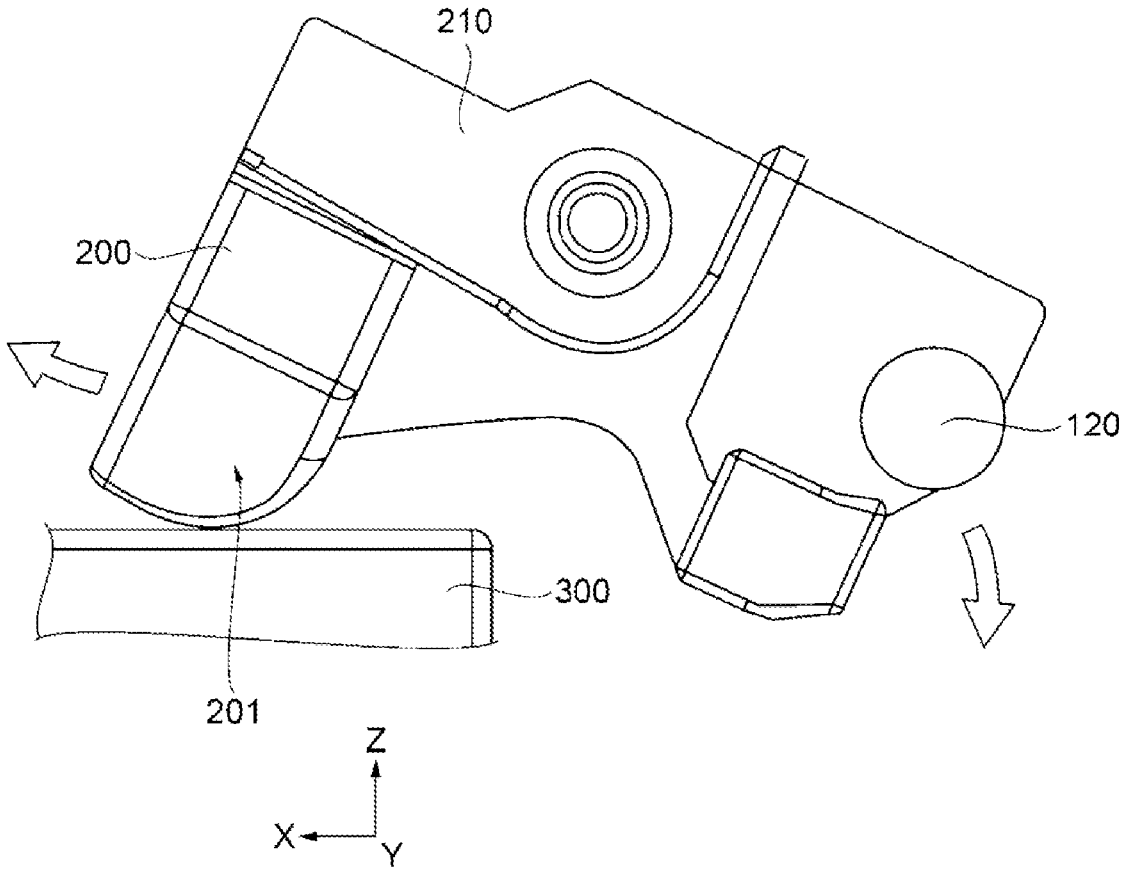
FIG. 13C is a side view illustrating an operation of the sheet feeding cassette and the roller separation mechanism unit.

FIGS. 11A, 12A, and 13A illustrate the first state as viewed in respective directions. FIGS. 11B, 12B, and 13B illustrate the second state as viewed in respective directions. FIGS. 11C, 12C, and 13C illustrate the third state as viewed in respective directions.

In FIG. 13A, a distance F between a position F1 where the contacted portion 200 and the contact portion 300 come into contact with each other and a rotation center F2 of the rotation shaft 130 in the first direction that is the X direction is preferably longer than a distance G between a point of action G1 where the pin contact portion 410 of the roller separation mechanism unit 210 acts on the pin 120 of the conveyance roller unit 110 and a rotation center G2. With the distance F between the position F1 where the contacted portion 200 and the contact portion 300 come into contact with each other and the rotation center F2 being longer as in this configuration, when the sheet feeding cassette 1600 is inserted into the device body 1100, the roller separation mechanism unit 210 biased in a direction in which the conveyance roller 100 is separated from the sheet 1500 can be rotated in the direction opposite to the biased direction with a small amount of force.

The contacted portion 200 preferably presses the contact portion 300 in the vertical direction in the state where the sheet feeding cassette 1600 is set in the device body 1100, that is, in the third state illustrated in FIG. 13C. With this configuration, the contacted portion 200 presses the contact portion 300 in the vertical direction meaning that no pressing force is applied to the sheet feeding cassette 1600 from the roller separation mechanism unit 210 in the attachment/detachment direction of the sheet feeding cassette 1600 in the device body 1100. Thus, the sheet feeding cassette 1600 can stay at the set position in the device body 1100.

Next, with reference to FIGS. 14 to 16, a description will be given on load and moment produced in the contact portion 300 of the sheet feeding cassette 1600 and the contacted portion 200 of the roller separation mechanism unit 210.

Figure 14:
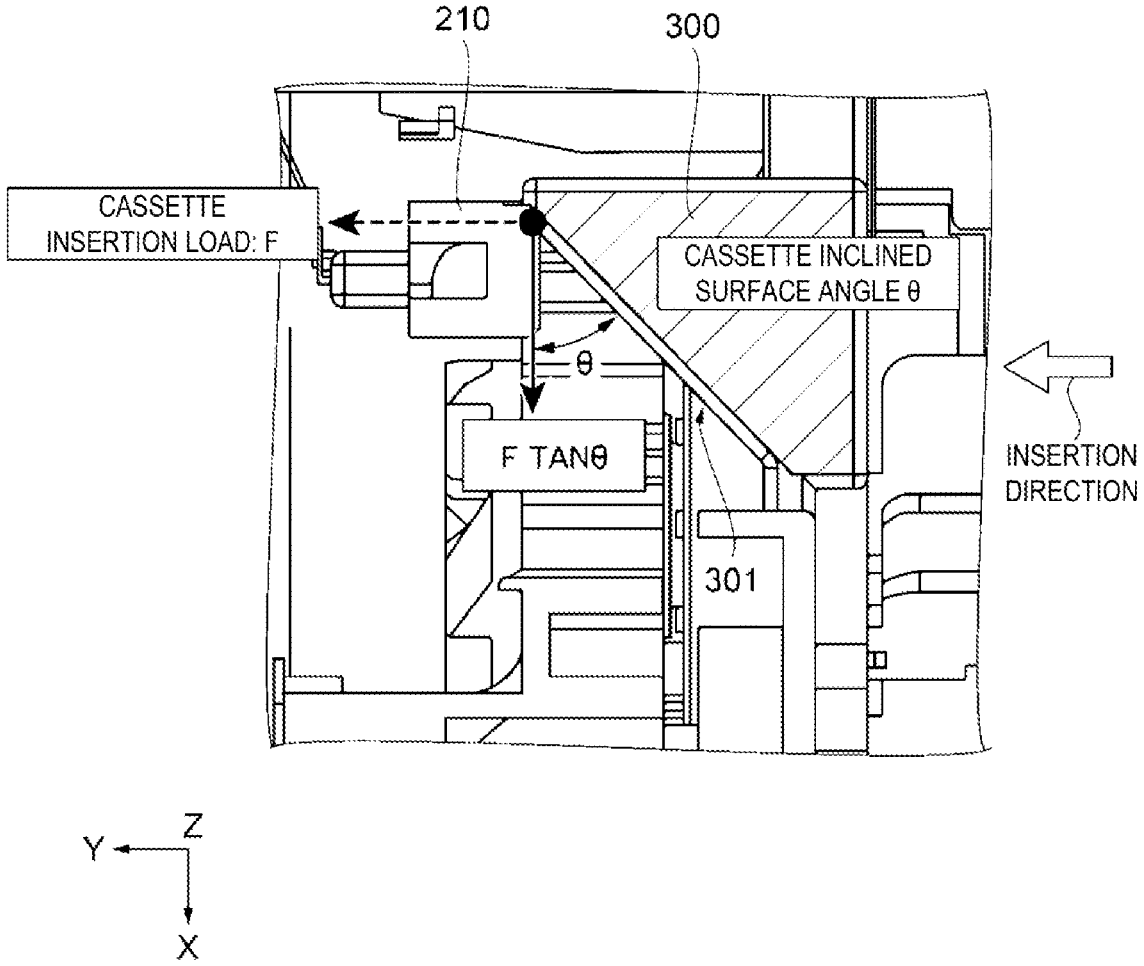
FIG. 14 is a diagram illustrating a load produced in the sheet feeding cassette and the roller separation mechanism unit.

As illustrated in FIG. 14, force F of the roller separation mechanism unit 210 produced in a direction indicated by a solid arrow in response to the insertion with the contact portion 300 of the sheet feeding cassette 1600 being in contact with the contacted portion 200 of the roller separation mechanism unit 210 is obtained. This F is assumed to be an insertion load of the sheet feeding cassette 1600. An angle θ is formed between the contact portion 300 of the sheet feeding cassette 1600 and the first inclined surface 301. In this state, the load of the roller separation mechanism unit 210 in the direction of the solid arrow is F·TAN θ. As illustrated in FIG. 14, the angle θ is an acute angle formed by intersection between the first inclined surface 301 and the X axis.

Figure 15:
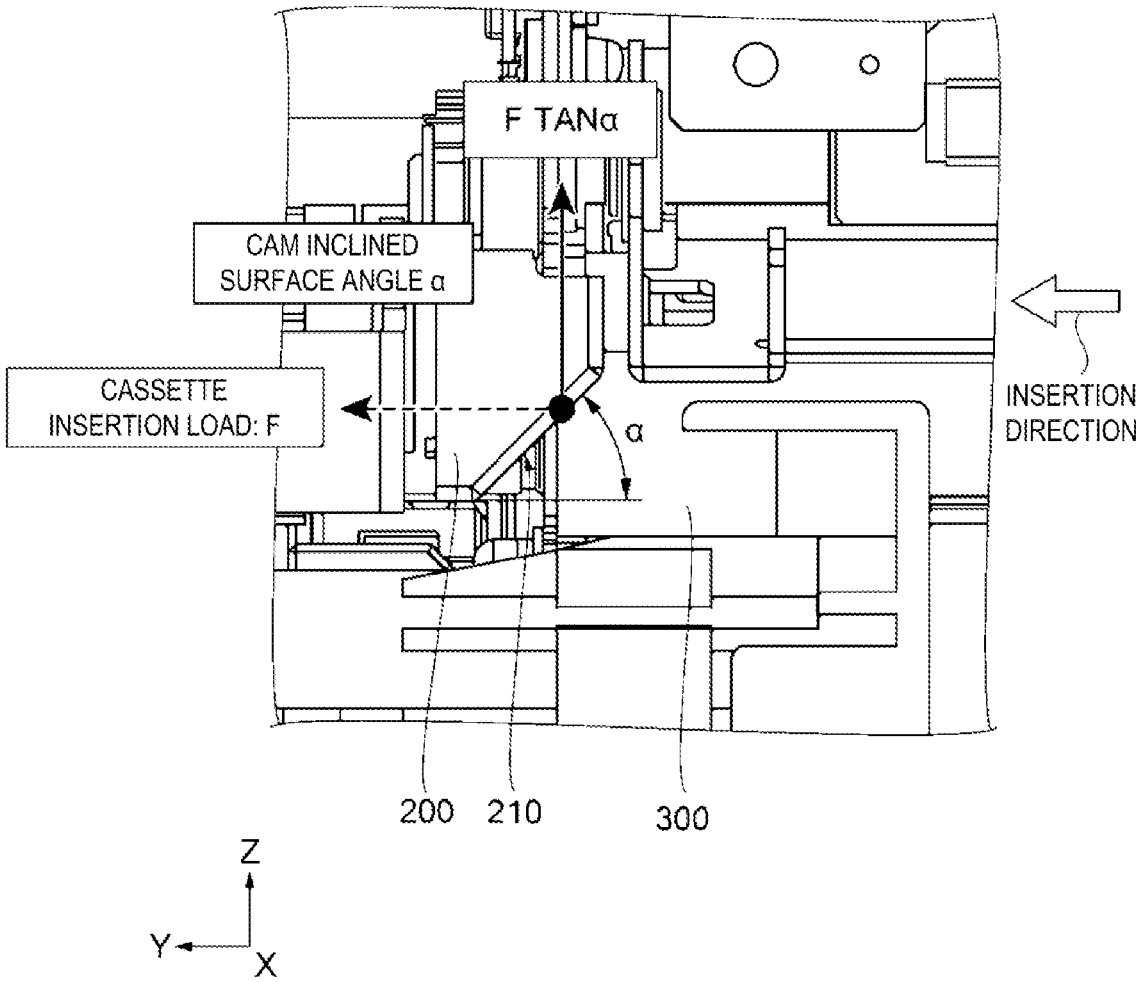
FIG. 15 is a diagram illustrating a load produced in the sheet feeding cassette and the roller separation mechanism unit.

Next, as illustrated in FIG. 15, force F of the roller separation mechanism unit 210 produced in a direction indicated by a solid arrow in response to the insertion with the contact portion 300 of the sheet feeding cassette 1600 being in contact with the contacted portion 200 of the roller separation mechanism unit 210 is obtained. This F is assumed to be an insertion load of the sheet feeding cassette 1600. An angle α is formed between the contacted portion 200 of the roller separation mechanism unit 210 and the second inclined surface 201. In this state, the load of the roller separation mechanism unit 210 in the direction of the solid arrow is F·TAN α. As illustrated in FIG. 15, the angle α is an acute angle formed by intersection between the second inclined surface 201 and the Y axis.

Figure 16:
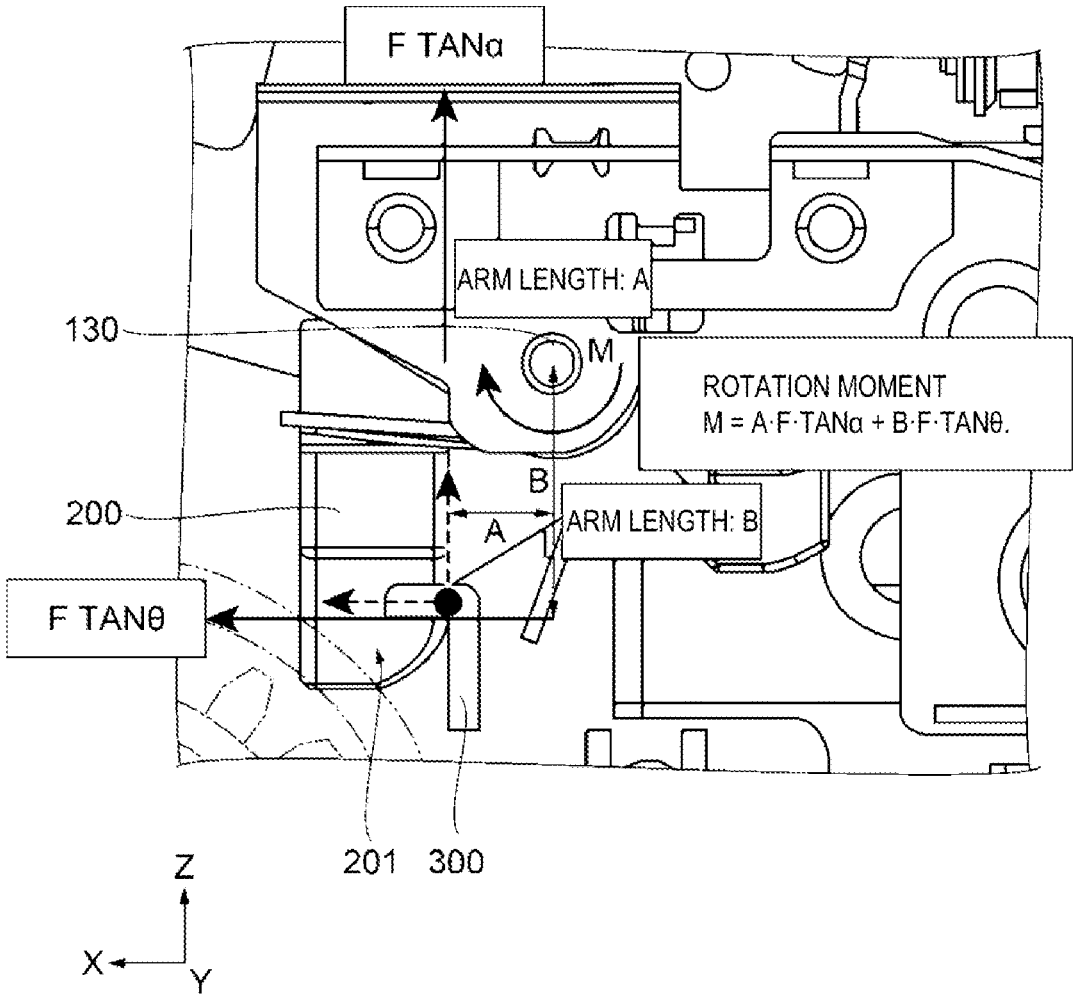
FIG. 16 is a diagram illustrating a rotation moment produced in the roller separation mechanism unit.

Next, as illustrated in FIG. 16, a rotation moment M of the roller separation mechanism unit 210 is obtained. A distance between the rotation shaft 130 and the contacted portion 200 of the roller separation mechanism unit 210 is defined as a length A. A distance from the rotation shaft 130 to a point of contact between the contacted portion 200 of the roller separation mechanism unit 210 and the contact portion 300 of the sheet feeding cassette 1600 is defined as a length B. The rotation moment M is obtained as M=A·F·TAN α+B·F·TAN θ.

A comparison is made with the known configuration not having the first inclined surface 301 in the contact portion 300 of the sheet feeding cassette 1600. The rotation moment M is A·F·TAN α in the known configuration. Thus, a larger rotation moment M than that in the known configuration can be achieved, whereby the insertion load for the sheet feeding cassette 1600 can be reduced. As a result, the sheet feeding cassette 1600 can be inserted into the device body 1100 with a small amount of force. With the required rotation load reduced without increasing the lever ratio from the rotation shaft 130 of the roller separation mechanism unit 210, the roller separation mechanism unit 210 can be downsized.

As described above, the medium conveyance device 1000*a* of the present embodiment includes the device body 1100, the sheet feeding cassette 1600 detachably provided to the device body 1100, the conveyance roller 100 configured to come into contact with an upper surface of the sheet 1500 placed on the sheet feeding cassette 1600 and convey the sheet 1500, and the roller separation mechanism unit 210 that includes the first biasing unit 401 configured to perform biasing in a direction in which the conveyance roller 100 is separated from the sheet 1500, has a rotation center along the attachment/detachment direction of the sheet feeding cassette 1600, rotates in response to an operation of inserting the sheet feeding cassette 1600 to bring the conveyance roller 100 into contact with the sheet 1500, and rotates in response to an operation of taking out the sheet feeding cassette 1600 to move the conveyance roller 100 away from the sheet 1500, wherein a direction orthogonal to the attachment/detachment direction is defined as the first direction and a direction orthogonal to the attachment/detachment direction and to the first direction is defined as the second direction, the sheet feeding cassette 1600 includes the contact portion 300 that comes into contact with the roller separation mechanism unit 210, the contact portion 300 including the first inclined surface 301 inclined to extend along a straight line including a component in the attachment/detachment direction and a component in the first direction, and the roller separation mechanism unit 210 includes the contacted portion 200 that comes into contact with the contact portion 300, the contacted portion 200 including the second inclined surface 201 inclined to extend along a straight line including a component in the attachment/detachment direction and a component in the second direction.

With the contact portion 300 having the first inclined surface 301 and the contacted portion 200 having the second inclined surface 201 coming into contact with each other along the inclined surfaces when the sheet feeding cassette 1600 is inserted into the device body 1100 as in this configuration, the roller separation mechanism unit 210 biased in a direction in which the conveyance roller 100 separates from the sheet 1500 can be gradually rotated in a direction opposite to the biased direction. Thus, the sheet feeding cassette 1600 can be smoothly pressed, whereby the sheet feeding cassette 1600 can be set in the device body 1100 with a small amount of force. As a result, the conveyance roller 100 can be brought into contact with the sheet 1500.

With the contact portion 300 provided with the first inclined surface 301 and with the contacted portion 200 provided with the second inclined surface 201, production of the rotation moment M for rotating the roller separation mechanism unit 210 is facilitated. Thus, an insertion load for the sheet feeding cassette 1600 can be reduced without increasing the length of the roller separation mechanism unit 210. Thus, the roller separation mechanism unit 210 can have a small size, whereby the printer 1000 can be downsized.

In the medium conveyance device 1000*a* of the present embodiment, the distance F between the rotation center F2 and the position F1 where the contacted portion 200 and the contact portion 300 come into contact with each other in the first direction is preferably longer than the distance G between the rotation center G2 and the point of action G1 where the action on the conveyance roller 100 takes place in the roller separation mechanism unit 210. With the distance F between the position F1 where the contacted portion 200 and the contact portion 300 come into contact with each other and the rotation center F2 being longer as in this configuration, when the sheet feeding cassette 1600 is inserted into the device body 1100, the roller separation mechanism unit 210 biased in a direction in which the conveyance roller 100 is separated from the sheet 1500 can be rotated in the direction opposite to the biased direction with a small amount of force.

In the medium conveyance device 1000*a* of the present embodiment, the contacted portion 200 preferably presses the contact portion 300 in the vertical direction in the state where the sheet feeding cassette 1600 is set in the device body 1100. With this configuration, the contacted portion 200 presses the contact portion 300 in the vertical direction meaning that no pressing force is applied to the sheet feeding cassette 1600 from the roller separation mechanism unit 210 in the attachment/detachment direction of the sheet feeding cassette 1600 in the device body 1100. Thus, the sheet feeding cassette 1600 can stay at the set position in the device body 1100.

The printer 1000 of the present embodiment includes the medium conveyance device 1000*a* described above and the head unit 600 that performs recording on the sheet 1500 conveyed from the medium conveyance device 1000*a*. With the medium conveyance device 1000*a* provided as in this configuration, the printer 1000 offering high usability can be provided.

Modifications of the embodiment described above will be described below.

Figure 17:
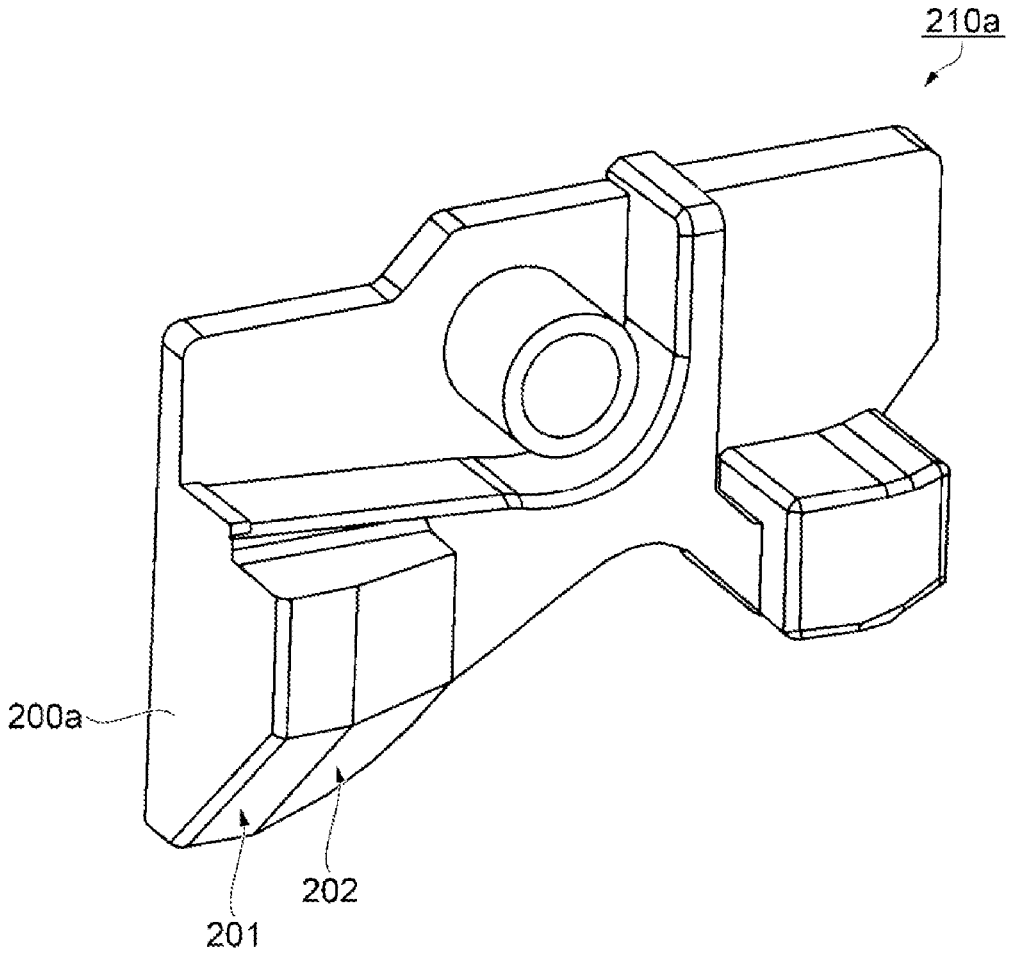
FIG. 17 is a perspective view illustrating a configuration of a roller separation mechanism unit of a modification.
Figure 18:
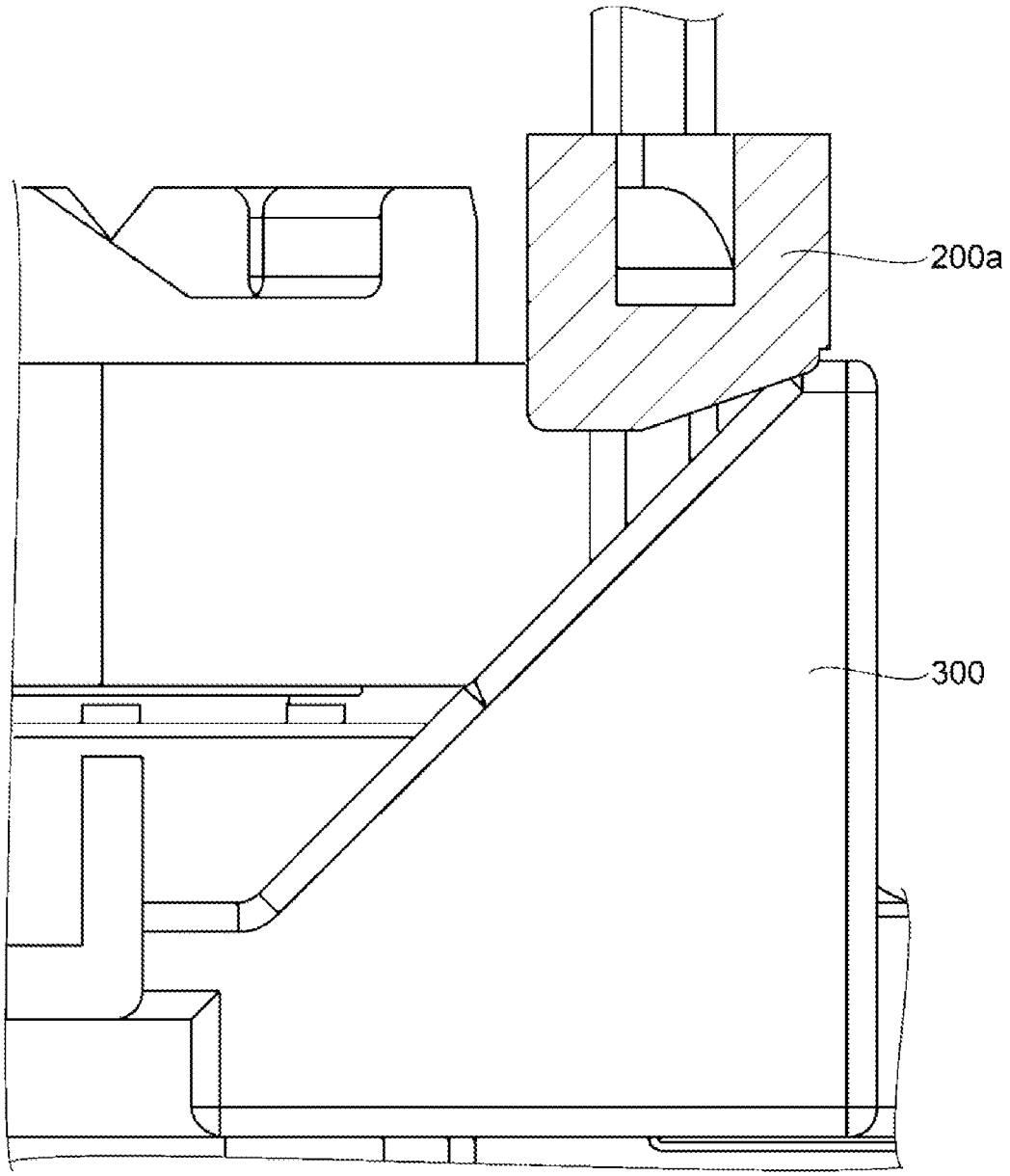
FIG. 18 is a plan view illustrating a configuration of the roller separation mechanism unit of the modification.

The contacted portion 200 of the roller separation mechanism unit 210 is not limited to the configuration provided with the second inclined surface 201 as described above, and may be configured as illustrated in FIG. 17 and FIG. 18. A contacted portion 200*a* of a roller separation mechanism unit 210*a* of a modification illustrated in FIG. 17 and FIG. 18 is provided with a fourth inclined surface 202 in addition to the second inclined surface 201.

The fourth inclined surface 202 has an angle of inclination different from that of the second inclined surface 201. With the contacted portion 200*a* provided with the second inclined surface 201 and the fourth inclined surface 202, the speed of the conveyance roller 100 moving when the sheet feeding cassette 1600 is inserted into the device body 1100 can be changed in accordance with the amount of separation from the sheet 1500. The two inclined surfaces 201 and 202 should not be construed in a limiting sense, and three or more inclined surfaces may be provided. Furthermore, the inclined surfaces may have an arc shape or a spherical shape.

As described above, the contacted portion 200 preferably has the fourth inclined surface 202 with an angle of inclination different from that of the second inclined surface 201. With the fourth inclined surface 202 having an angle of inclination different from that of the second inclined surface 201 provided as in this configuration, that is, with the inclined surface provided with steps, the amount of separation of the conveyance roller 100 from the sheet 1500 can be changed in a stepwise manner. In other words, the movement position and the movement speed of the conveyance roller 100 can be changed in accordance with the amount of insertion of the sheet feeding cassette 1600. Thus, jamming of the sheet 1500 inside the device body 1100 is prevented when the sheet feeding cassette 1600 is taken out.

Figure 19:
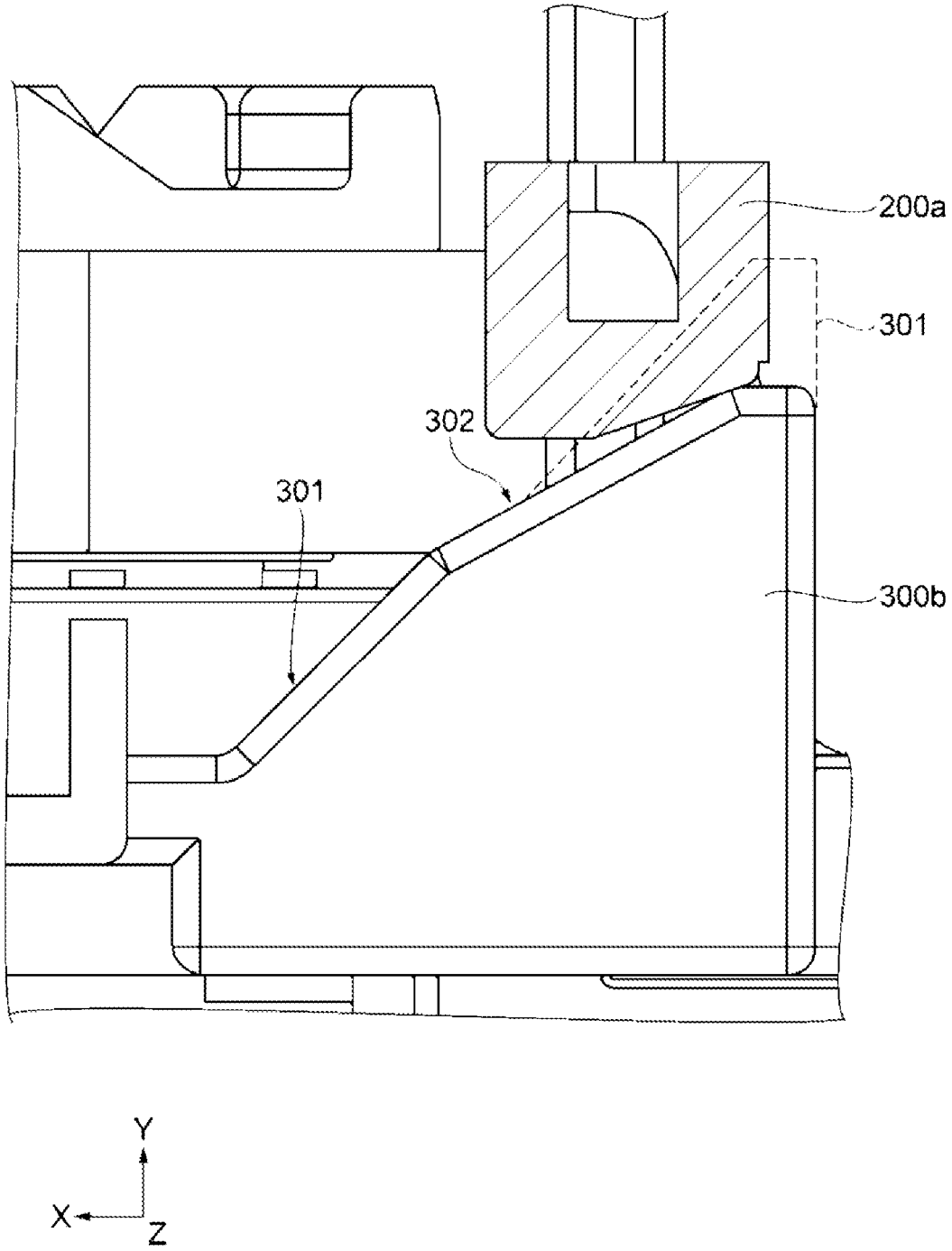
FIG. 19 is a plan view illustrating a configuration of a sheet feeding cassette of a modification.

The contact portion 300 of the sheet feeding cassette 1600 is not limited to the configuration provided with the first inclined surface 301 as described above, and may be configured as in FIG. 19. A contact portion 300*b* of this modification is provided with a third inclined surface 302 in addition to the first inclined surface 301.

The third inclined surface 302 is inclined to extend along a straight line including a component in the attachment/detachment direction and a component in the first direction, and has an angle of inclination different from that of the first inclined surface 301. With the contact portion 300*b* provided with the first inclined surface 301 and the third inclined surface 302, the speed of the conveyance roller 100 moving when the sheet feeding cassette 1600 is inserted into the device body 1100 can be changed in accordance with the amount of separation from the sheet 1500. The two inclined surfaces 301 and 302 should not be construed in a limiting sense, and three or more inclined surfaces may be provided. Furthermore, the inclined surfaces may have an arc shape or a spherical shape.

As described above, the contact portion 300 preferably has the third inclined surface 302 with an angle of inclination different from that of the first inclined surface 301. With the third inclined surface 302 having an angle of inclination different from that of the first inclined surface 301 provided as in this configuration, that is, with the inclined surface provided with steps, the amount of separation of the conveyance roller 100 from the sheet 1500 can be changed in accordance with the position where the contact portion 300 comes into contact with the contacted portion 200. In other words, the movement position and the movement speed of the conveyance roller 100 can be changed in accordance with the amount of insertion of the sheet feeding cassette 1600. Thus, jamming of the sheet 1500 inside the device body 1100 is prevented when the sheet feeding cassette 1600 is taken out.

The third inclined surface 302 is preferably inclined to extend along a straight line including a component in the attachment/detachment direction and a component in the first direction. With this configuration, the contacted portion 200 can gradually come into contact with the first inclined surface 301 and the third inclined surface 302 so that a huge amount of force can be prevented from being instantaneously applied to the contacted portion 200, whereby the contact portion 300 and the contacted portion 200 can be prevented from being damaged.

Figure 20:
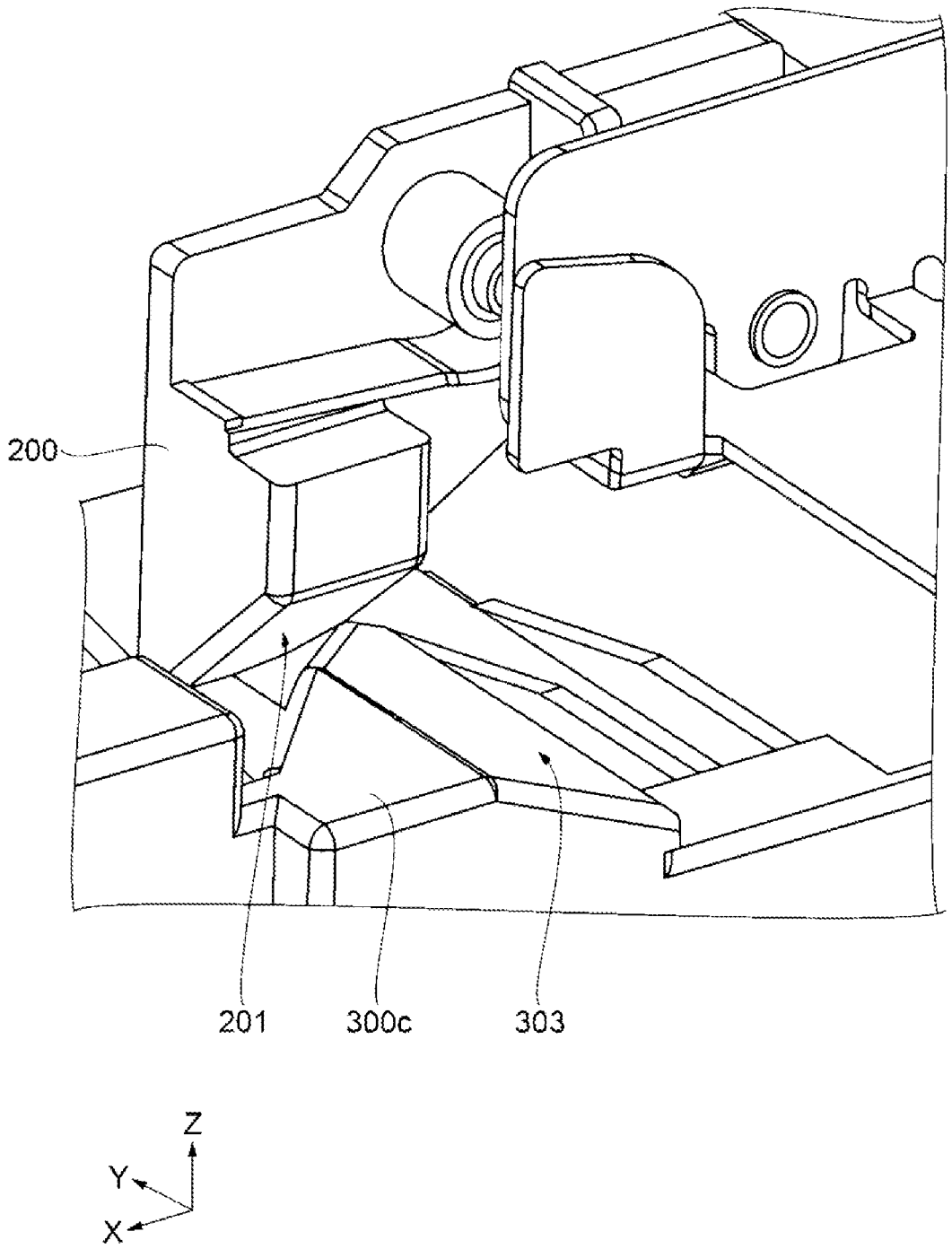
FIG. 20 is a perspective view illustrating a configuration of the sheet feeding cassette of the modification.

The contact portion 300*b* of the sheet feeding cassette 1600 is not limited to the configuration provided with the first inclined surface 301 and the third inclined surface 302 as in the modification described above, and can be configured as illustrated in FIG. 20. A contact portion 300*c* of this modification is provided with a fifth inclined surface 303 inclined in a height direction that is the −Z direction, in addition to the first inclined surface 301 and the third inclined surface 302.

With the contact portion 300*c* provided with the fifth inclined surface 303, the conveyance roller 100 can be slowly brought into contact with the sheet 1500. With the timing when the conveyance roller 100 comes into contact with the sheet 1500 thus adjusted, the sheet 1500 can be prevented from being jammed or remaining in the device body 1100 due to the conveyance roller 100 coming into contact with the sheet 1500 before the sheet feeding cassette 1600 is fully inserted or due to the sheet feeding cassette being inserted or pulled while the conveyance roller 100 is still in contact with the sheet 1500 at the time of taking out the sheet feeding cassette.

What is claimed is:

1. A medium conveyance device, comprising:

a device body;

a sheet feeding cassette detachably provided to the device body;

a conveyance roller configured to come into contact with an upper surface of a medium placed on the sheet feeding cassette to convey the medium; and a roller separation mechanism unit including a biasing unit configured to perform biasing in a direction in which the conveyance roller is separated from the medium, and having a rotation center along an attachment/detachment direction of the sheet feeding cassette, the roller separation mechanism unit being configured to rotate in response to an operation of inserting the sheet feeding cassette to bring the conveyance roller into contact with the medium, and configured to rotate in response to an operation of taking out the sheet feeding cassette to separate the conveyance roller from the medium, wherein a direction orthogonal to the attachment/detachment direction is defined as a first direction, and a direction orthogonal to the attachment/detachment direction and the first direction is defined as a second direction, the sheet feeding cassette includes a contact portion configured to come into contact with the roller separation mechanism unit and including a first inclined surface inclined to extend along a straight line including a component in the attachment/detachment direction and a component in the first direction, and the roller separation mechanism unit includes a contacted portion configured to come into contact with the contact portion and including a second inclined surface inclined to extend along a straight line including a component in the attachment/detachment direction and a component in the second direction.

2. The medium conveyance device according to claim 1, wherein a distance between the rotation center and a position where the contacted portion and the contact portion come into contact in the first direction is longer than a distance between the rotation center and a point of action where the roller separation mechanism unit acts on the conveyance roller.

3. The medium conveyance device according to claim 1, wherein the contacted portion is configured to press the contact portion in a vertical direction in a state where the sheet feeding cassette is set in the device body.

4. The medium conveyance device according to claim 1, wherein the contact portion includes a third inclined surface having an angle of inclination different from an angle of inclination of the first inclined surface.

5. The medium conveyance device according to claim 4, wherein the third inclined surface is inclined to extend along a straight line including a component in the attachment/detachment direction and a component in the first direction.

6. The medium conveyance device according to claim 1, wherein the contacted portion includes a fourth inclined surface having an angle of inclination different from an angle of inclination of the second inclined surface.

7. A recording device comprising:

the medium conveyance device described in claim 1; and a recording unit configured to perform recording on the medium conveyed from the medium conveyance device.

* * * * *